US011012770B2

(12) United States Patent
Hatfield et al.

(10) Patent No.: US 11,012,770 B2
(45) Date of Patent: May 18, 2021

(54) EARTIPS FOR IN-EAR LISTENING DEVICES

(71) Applicant: Apple Inc., Cupertino, CA (US)

(72) Inventors: Dustin A. Hatfield, Los Gatos, CA (US); Shota Aoyagi, San Francisco, CA (US); Timothy E. Emmott, San Francisco, CA (US); Ethan L. Huwe, Davis, CA (US); Mitchell R. Lerner, San Francisco, CA (US); Sean T. McIntosh, Cupertino, CA (US); Yi-Fang D. Tsai, Mountain View, CA (US); Jason C. Della Rosa, Morgan Hill, CA (US); Patrick W. Sheppard, San Francisco, CA (US); Samuel G. Parker, Woodside, CA (US); David J. Feathers, San Jose, CA (US); Brian R. Twehues, Campbell, CA (US); Daniel Strongwater, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/584,940

(22) Filed: Sep. 26, 2019

(65) Prior Publication Data

US 2020/0314519 A1 Oct. 1, 2020

Related U.S. Application Data

(60) Provisional application No. 62/823,592, filed on Mar. 25, 2019.

(51) Int. Cl.
*H04R 1/10* (2006.01)

(52) U.S. Cl.
CPC ..... *H04R 1/1016* (2013.01); *H04R 2460/11* (2013.01)

(58) Field of Classification Search
CPC ..... H04R 2460/17; H04R 2225/023; H04R 2225/025; H04R 2460/13; H04R 1/1016
(Continued)

(56) References Cited

U.S. PATENT DOCUMENTS 2,486,038 A * 10/1949 Landon ..... B28B 7/168 249/177
4,879,750 A * 11/1989 Nassler ..... H04R 25/654 381/325

(Continued)

OTHER PUBLICATIONS

International Search Report and Written Opinion issued in PCT Application No. PCT/US2020/019280, dated Jul. 29, 2020 in 21 pages.

(Continued)

*Primary Examiner* — Suhan Ni
(74) *Attorney, Agent, or Firm* — Kilpatrick Townsend & Stockton LLP

(57) ABSTRACT

Embodiments describe an eartip including an eartip body having an attachment end and an interfacing end opposite from the attachment end, and including an inner eartip body and an outer eartip body. The inner eartip body has a sidewall that extends between the interfacing end and the attachment end, and includes a groove formed in an outer surface of the sidewall. The outer eartip body is sized and shaped to be inserted into an ear canal and extends from the interfacing end toward the attachment end of the eartip.

23 Claims, 15 Drawing Sheets

(58) Field of Classification Search
USPC ..... 381/325, 328, 380
See application file for complete search history.

(56) References Cited

U.S. PATENT DOCUMENTS

| | | | | |
|---|---|---|---|---|
| 4,953,215 | A * | 8/1990 | Weiss | H04R 25/654 181/130 |
| 6,134,333 | A * | 10/2000 | Flagler | H04R 25/652 181/130 |
| 6,724,902 | B1 * | 4/2004 | Shennib | H04R 25/456 381/322 |
| 8,348,011 | B1 | 1/2013 | Huang | |
| 2014/0166388 | A1 | 6/2014 | Yang | |

OTHER PUBLICATIONS

Invitation to Pay Additional Fees and, Where Applicable, Protest Fee issued in PCT Application No. PCT/US2020/019280, dated Jun. 5, 2020 in 12 pages.

* cited by examiner

EARTIPS FOR IN-EAR LISTENING DEVICES

CROSS REFERENCES TO RELATED APPLICATIONS

This application claims priority to U.S. Provisional Patent Application No. 62/823,592, filed on Mar. 25, 2019, the disclosure of which is hereby incorporated by reference in its entirety and for all purposes.

BACKGROUND

In-ear listening devices can be used with a wide variety of electronic devices such as portable media players, smart phones, tablet computers, laptop computers, stereo systems, and other types of devices. In-ear listening devices have historically included one or more small components configured to be placed in a user's ear, a driver that outputs sound through the component(s), and a cable that electrically connects the in-ear listening device to an audio source. Other in-ear listening devices can be wireless devices that do not include a cable and instead, wirelessly receive a stream of audio data from a wireless audio source. Such in-ear listening devices can include, for instance, wireless earbud devices or in-ear hearing devices that operate in pairs (one for each ear) or individually for outputting sound to, and receiving sound from, the user. For noise reduction, some in-ear listening devices can include an eartip that at least partially inserts into the user's ear canal. The eartip can direct sound outputted by the in-ear listening device through its sound channel and directly into the user's ear canal.

While eartips for wireless listening devices can improve noise reduction for some users, they also have some potential drawbacks. For example, eartips often improperly fit in a user's ear canal, which can cause discomfort for the user. Improperly fitting eartips can also result in a collapse of the sound channel, which can decrease acoustic performance and require the use of large drivers to compensate for lost performance. Implementing large drivers in wireless listening devices can result in a bulky in-ear listening device with poor battery life.

SUMMARY

Some embodiments of the disclosure provide an eartip for a wireless listening device that achieves improved comfort and acoustic performance, a smaller device footprint, and improved battery life, thereby resulting in an enriched user experience. The eartip is designed to easily bend and conform to a large variation of ear canal profiles so that the eartip can properly and comfortably fit in the ear canals of a vast majority of a user population without collapsing the sound channel.

In some instances, the eartip can include an eartip body formed of an inner eartip body and an outer eartip body. The inner eartip body can form the sound channel through which sound outputted by a driver in a housing of the wireless listening device can be outputted into an ear canal, and the outer eartip body can form an acoustic seal with the ear canal by bending and conforming to the contours of the ear canal. In certain embodiments, various modifications to the inner eartip body and an implementation of support structures for the outer eartip body can improve the eartip's fit in an ear canal to achieve improved comfort and acoustic performance for the user. As an example, the inner eartip body can include a series of grooves around a circumference of the inner eartip body to allow the inner eartip body to easily bend and conform to an ear canal profile without collapsing. Support structures can be implemented in vacant space between the inner eartip body and the outer eartip body to resist total deflection of the outer eartip body when the eartip is inserted into an ear canal. Configuring an eartip with the grooves and/or support structures can improve user comfort and acoustic performance, as well as decrease device size and increase battery life.

In some embodiments, an eartip includes an eartip body having an attachment end and an interfacing end opposite from the attachment end, the eartip body including an inner eartip body and an outer eartip body. The inner eartip body can have a sidewall that extends between the interfacing end and the attachment end, and can include a groove formed in an outer surface of the sidewall. The outer eartip body can be sized and shaped to be inserted into an ear canal and can extend from the interfacing end toward the attachment end of the eartip.

The groove can be defined by a base wall extending between two sidewalls. The base wall and at least one sidewall of the two sidewalls can be arranged perpendicular to one another. The groove can be a first groove and the inner eartip body can include a second groove spaced apart from the first groove along a length of the inner eartip body. The first groove and the second groove can be positioned closer to the attachment end than the interfacing end. The inner eartip body can further include a boundary positioned between the interfacing end and the attachment end, where the sidewall gradually changes in thickness from the first thickness to the second thickness from the boundary to the interfacing end. The groove can be defined by a base wall extending between two sidewalls having different lengths. The groove can extend around a circumference of the inner eartip body. The eartip can further include an internal sound sealing structure extending from the inner eartip body and positioned between the groove and the attachment end. The internal sound sealing structure can be a flange that extends toward the outer eartip body. The eartip can further include a support structure extending from the inner eartip body toward the outer eartip body. The support structure can include a plurality of flanges, each extending around the circumference of the inner eartip body and positioned across a majority of the length of the inner eartip body. The support structure can include a shell and an inner region filled with air. The eartip can further include an attachment structure coupled to the inner eartip body at the attachment end of the eartip body.

In some additional embodiments, an eartip includes an eartip body and an attachment structure. The eartip body includes an attachment end and an interfacing end opposite from the attachment end, and an inner eartip body that defines a channel that extends between the interfacing end and the attachment end, the inner eartip body including a groove formed in an outer surface of the sidewall. The attachment structure can be coupled to the inner eartip body at the attachment end, and can define a plurality of recesses and including a mesh extending across the channel.

The eartip body further can include an outer eartip body sized and shaped to be inserted into an ear canal and extending from the interfacing end toward the attachment end of the eartip. The groove can be defined by a base wall extending between two sidewalls.

In some further embodiments, an in-ear listening device includes: a housing defining a cavity and an acoustic opening; a driver positioned within the housing and operatively coupled to emit sound through the acoustic opening; and an eartip removably attached to the housing and aligned with the acoustic opening. The eartip includes an eartip body having an attachment end and an interfacing end opposite from the attachment end, the eartip body including an inner eartip body and an outer eartip body. The inner eartip body can have a sidewall that extends between the interfacing end and the attachment end, and can include a groove formed in an outer surface of the sidewall. The outer eartip body can be sized and shaped to be inserted into an ear canal and can extend from the interfacing end toward the attachment end of the eartip.

The eartip body can further include an attachment structure coupled to the inner eartip body at the attachment end, the attachment structure defining a plurality of recesses and including a mesh extending across the channel. The groove can be defined by a base wall extending between two sidewalls.

A better understanding of the nature and advantages of embodiments of the present invention may be gained with reference to the following detailed description and the accompanying drawings.

DETAILED DESCRIPTION OF THE INVENTION

Figure 1:
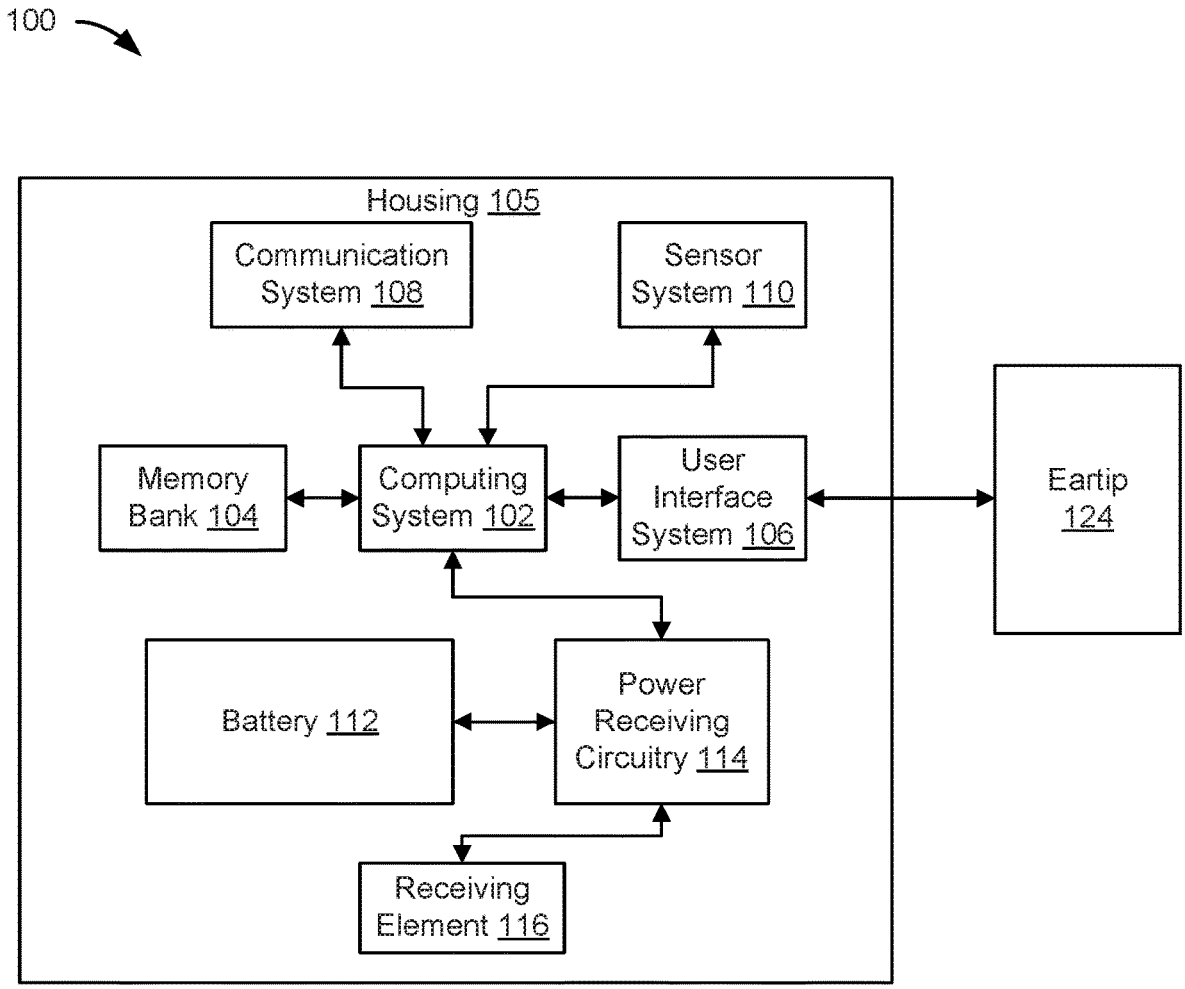
FIG. 1 is a block diagram of an exemplary wireless listening device, according to some embodiments of the present disclosure.

Embodiments of the disclosure describe a wireless listening device that achieves improved user comfort and acoustic performance. The wireless listening device can be one of a pair of wireless listening devices configured to fit in the left and right ears of a user for outputting sound to the user. In some instances, the wireless listening device can include a housing and an eartip that can attach to the housing. The housing can include a rigid outer structure that encloses various electrical components that operate the wireless listening device (e.g., a battery, a processor, a driver for generating sound, and the like). The outer structure can include an opening through which the generated sound can be outputted to the eartip, which can then direct the sound into the user's ear canal. The eartip can be substantially pliable in construction but include a stiff attachment mechanism that enables the eartip to easily attach to the housing by inserting into the opening of the outer structure.

According to some embodiments, the eartip can be formed of an inner eartip body and an outer eartip body extending from an end of the inner eartip body. An inner diameter of the inner eartip body can form a sound channel through which sound can pass through from a driver in a housing of the listening device to a user's ear canal. An outer surface of the inner eartip body can include grooves that extend around at least a portion of the inner eartip body. The grooves can be evenly spaced apart along at least a portion of the length of the inner eartip body. Each groove can include a base wall and a pair of sidewalls that form a cavity in a surface of the inner eartip body when viewed from a cross-sectional perspective. The grooves can provide a degree of controlled bendability to the inner eartip body such that the inner eartip body resists kinking or sharp deformations when it conforms to the profile of the ear canal.

The eartip can also be configured to include support structures to help evenly distribute pressure against the ear canal when the wireless listening device is worn by the user. The support structures can be formed of a balloon structure, honeycomb structure, or one or more flanges. The support structures can be formed on an outer diameter of the inner eartip body or on an inner surface of the outer eartip body, as will be discussed further herein. The support structures can help mitigate the creation of pressure points against the ear canal when the wireless listening device is worn and help increase the surface area of contact between the outer eartip body and the ear canal surface, thereby improving comfort and acoustic performance.

As used herein, the term "in-ear listening device" includes any portable device designed to play sound directly into a user's ear canal to be heard by a user. In-ear listening devices can include an eartip that is attachable to a housing, which can be configured to generate sound into the eartip and be directed by the eartip into the ear canal. The term "eartip", which can also be referred to as earmold, includes pre-formed, post-formed, or custom-molded sound-directing structures that at least partially fit within an ear canal. Eartips can be formed to have a comfortable fit capable of being worn for long periods of time. They can have different sizes and shapes to achieve a better seal with a user's ear canal and/or ear cavity, as will be discussed further herein.

I. Wireless Listening Device

FIG. 1 is a block diagram illustrating an exemplary wireless listening device 100, according to some embodiments of the present disclosure. Wireless listening device 100, as mentioned above, can include a housing 105. Housing 105 can be an electronic device component that generates and receives sound to provide an enhanced user interface for a host device, such as a smart phone (not shown). Housing 105 can include a computing system 102 coupled to a memory bank 104. Computing system 102 can execute instructions stored in memory bank 104 for performing a plurality of functions for operating housing 105. Computing system 102 can be one or more suitable computing devices, such as microprocessors, computer processing units (CPUs), graphics processing units (GPUs), field programmable gate arrays (FPGAs), and the like.

Computing system 102 can also be coupled to a user interface system 106, communication system 108, and a sensor system 110 for enabling housing 105 to perform one or more functions. For instance, user interface system 106 can include a driver (e.g., speaker) for outputting sound to a user, microphone for inputting sound from the environment or the user, and any other suitable input and output device. Communication system 108 can include Bluetooth components for enabling housing 105 to send and receive data/commands from a host device (not shown). The host device, to which housing 105 is an accessory, can be a portable electronic device, such as a smart phone, tablet, or laptop computer. The host device can include a host communication system that can communicate with communication system 108 in housing 105 via a wireless communication line so that the host device can send sound data to housing 105 to output sound, and receive data from housing 105 to receive user inputs. Sensor system 110 can include optical sensors, accelerometers, microphones, and any other type of sensor that can measure a parameter of an external entity and/or environment.

Housing 105 can also include a battery 112, which can be any suitable energy storage device, such as a lithium ion battery, capable of storing energy and discharging stored energy to operate housing 105. The discharged energy can be used to power the electrical components of housing 105. In some embodiments, battery 112 can also be charged to replenish its stored energy. For instance, battery 112 can be coupled to power receiving circuitry 114, which can receive current from receiving element 116. Receiving element 116 can electrically couple with a transmitting element 118 of an external charging device, such as a case (not shown).

According to some embodiments of the present disclosure, wireless listening device 100 can include an eartip 124, and thus be configured as an in-ear hearing device. Eartip 124 can be specifically designed to achieve a comfortable fit in a user's ear canal while also achieving high acoustic performance, as will be discussed further herein. Eartip 124 can attach to, and detach from, housing 105 as shown in FIGS. 2A and 2B.

Figure 2A:
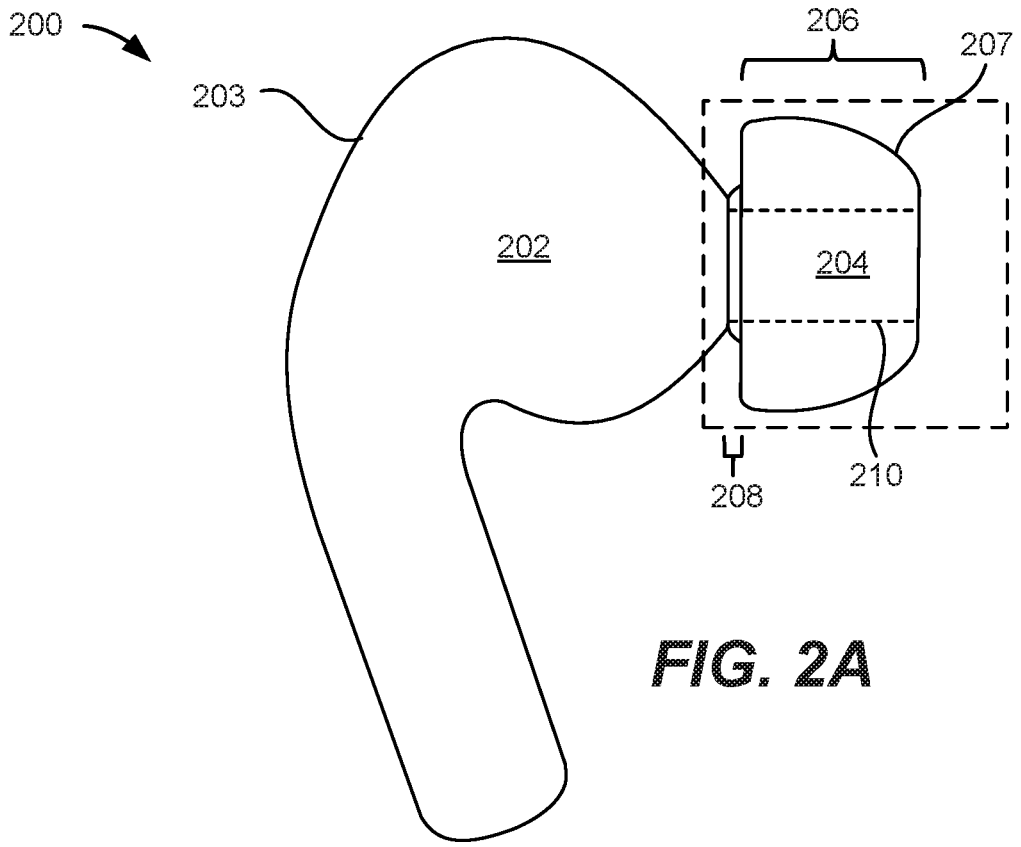
FIG. 2A is a side-view illustration of an exemplary wireless listening device where an eartip is attached to a housing, according to some embodiments of the present disclosure.
Figure 2B:
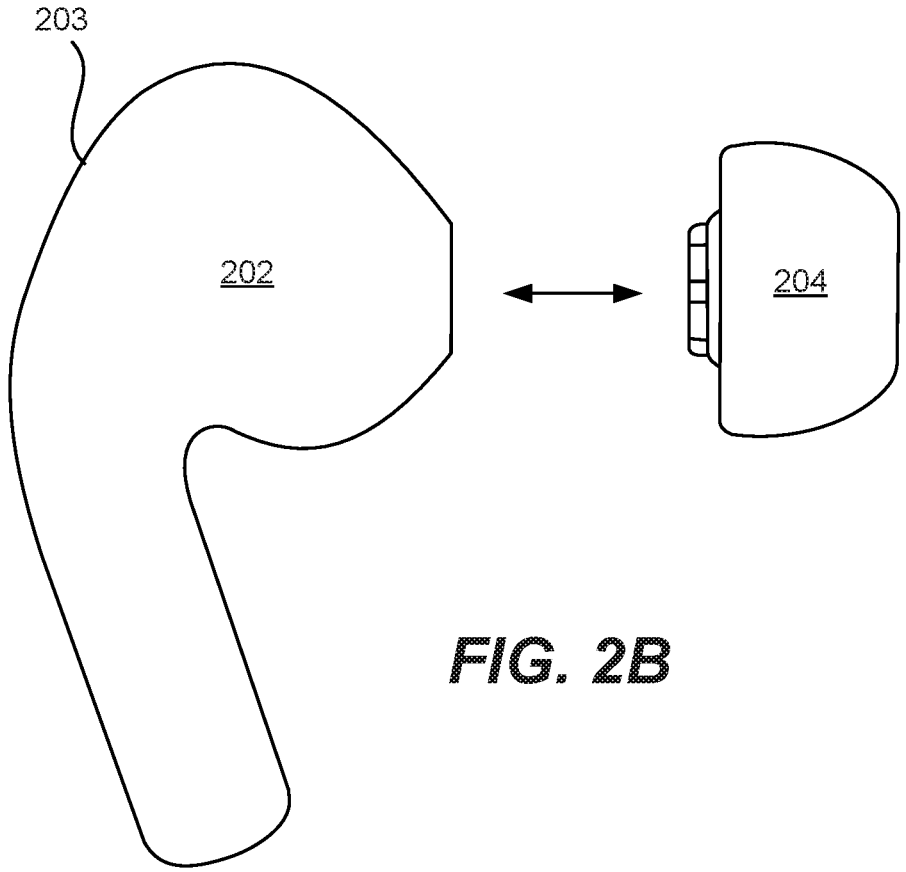
FIG. 2B is a side view illustration of a wireless listening device where an eartip is detached from a housing, according to some embodiments of the present disclosure.

FIG. 2A is a side-view illustration of an exemplary wireless listening device 200 including a housing 202 and an eartip 204 attached to housing 202, according to some embodiments of the present disclosure; and FIG. 2B is a side view illustration of wireless listening device 200 where eartip 204 is detached from housing 202, according to some embodiments of the present disclosure. As shown in FIG. 2A, eartip 204 can include a tip region 206 and a base region 208 that together form a monolithic structure, and a sound channel 210 that extends through both tip region 206 and base region 208. Tip region 206 can include a curved, annular surface 207 that inserts into an ear canal for directing sound from housing 202 to the user, and can be formed of a pliable material that can easily bend to conform to the inner surfaces of the ear canal for forming an acoustic seal. Eartip 204 can be detached from housing 202, as shown in FIG. 2B, so that damaged eartips can be easily replaced or so that different types and/or sizes of eartips can be used to more comfortably fit in ear canals of different anatomical shapes and sizes.

Figure 3A:
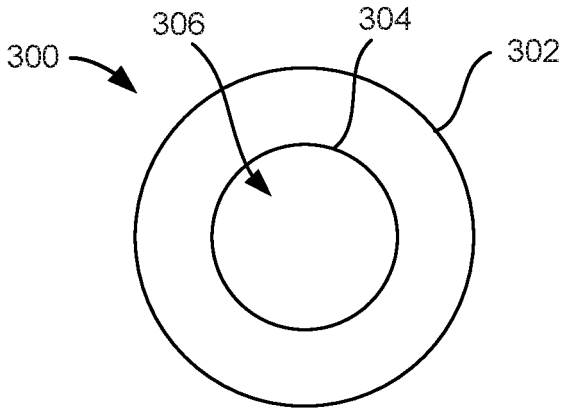
FIGS. 3A and 3B are top-down view illustrations of exemplary eartips, according to some embodiments of the present disclosure.

In some embodiments, eartip 204 can have various profile shapes. For instance, FIG. 3A is a top-down view illustration of an exemplary eartip 300 configured with a circular profile, according to some embodiments of the present disclosure. When configured with a circular profile, eartip 300 can have a substantially circular outer diameter 302 and inner diameter 304, which forms a circular sound channel 306. Being configured with a circular profile enables eartip 300 to easily bend in all directions. However, some portions of ear canals may not have a substantially circular cross-sectional shape and thus may be difficult for eartip 300 to achieve a proper fit. Thus, in some embodiments, an eartip can be configured to have profiles configured in other shapes.

Figure 3B:
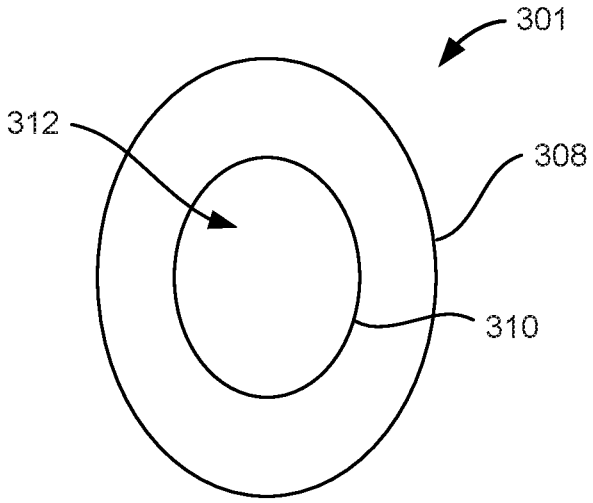

FIG. 3B is a top-down view illustration of an exemplary eartip 301 configured with an ovular profile, according to some embodiments of the present disclosure. When configured with an ovular profile, eartip 301 can have a substantially ovular outer diameter 308 and inner diameter 310, which forms an ovular sound channel 312. The ovular profile allows eartip 301 to more easily conform to the natural shape of some portions of ear canals. However, the ovular profile may make it more difficult to bend eartip 301 in the vertical direction than it may be to bend eartip 301 in the horizontal direction. As will be appreciated from disclosures herein, a plurality of notches can be implemented in the construction of eartip 301 to improve bendability to achieve a proper fit in an ear canal. Furthermore, an eartip can have various other configurations that result in improved user comfort and sound quality. The details of such configurations and functionalities are discussed further herein.

II. Eartip Configurations

Figure 4:
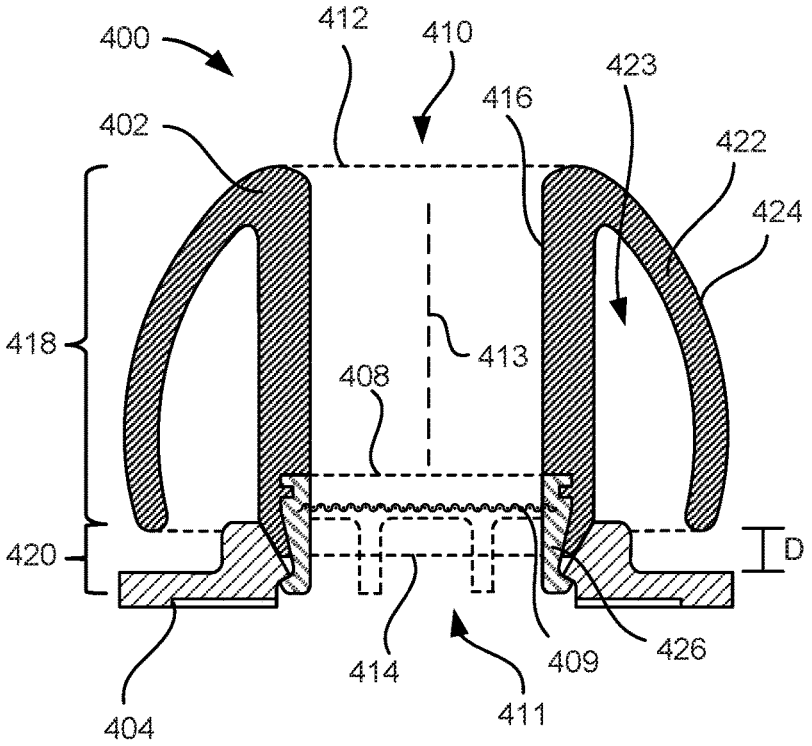
FIG. 4 is a cross-sectional view illustration of an eartip attached to an outer structure of a housing via an attachment mechanism, according to some embodiments of the present disclosure.

FIG. 4 is a cross-sectional view 400 of an exemplary eartip 402 attached to an outer structure 404 of a housing. Eartip 402 can include an inner eartip body 416 and an outer eartip body 422 that together form a monolithic structure. Inner eartip body 416 can be centered along a central axis 413 and define a sound channel 410 that extends through the entire length of eartip 402 between an ear-interfacing end 412 and an attachment end 414. Sound channel 410 can be vacant space through which sound can travel from attachment end 414 to ear-interfacing end 412. In some embodiments, attachment end 414 can be an end of eartip 402 that is configured to attach to outer structure 404 of the housing so that sound generated by the housing can pass into sound channel 410 through an acoustic opening 411 of outer structure 404; and, ear-interfacing end 412 can be an end of eartip 402 opposite from attachment end 414 that is configured to interface with (e.g., insert into) an ear canal of a user so that sound from the housing can be directed to the ear drum and thus be heard by the user. Ear-interfacing end 412 can face away from outer structure 404 when eartip 402 is attached to the housing and not worn by the user. When eartip 402 is attached to outer structure 404, sound channel 410 can be substantially aligned with acoustic opening 411 of outer structure 404 so that sound the from the housing can easily propagate into sound channel 410.

In some embodiments, eartip 402 can include a tip region 418 and a base region 420 (e.g., tip region 206 and base region 208 in FIG. 2). Tip region 418 can be a part of eartip 402 that inserts into the ear canal of the user while base region 420 can be a part of eartip 402 that extends toward and attaches to outer structure 404 of the housing. Eartip 402 can also include an outer eartip body 422. In some instance, outer eartip body 422 can be a part of tip region 418 that extends from, and is coupled to, inner eartip body 416 at ear-interfacing end 412 of eartip 402 toward attachment end 414. Outer eartip body 422 can bend and conform to the contours of the ear canal to form an acoustic seal to prevent sound from entering the ear canal as ambient noise. Thus, according to some embodiments of the present disclosure, outer eartip body 422 can be formed of a thin, compliant material, e.g., silicone, thermoplastic urethane, thermoplastic elastomer, or the like, that can easily bend and deflect inward and outward to conform to various contours of the ear canal. To allow outer eartip body 422 to deflect inward and outward, outer eartip body 422 can be like a cantilever where its end closest to attachment end 414 is positioned a distance away from inner eartip body 416 to define a deflection zone 423 formed of vacant space within which outer eartip body 422 can freely deflect. In some additional and alternative embodiments, inner eartip body 416 can also be formed of the same material but of a different, e.g., larger, thickness so that a substantial portion of eartip 400 as a whole can be formed of the compliant material. Inner eartip body 416 can have a larger thickness than outer eartip body 422 because it does not contact the ear canal and provides some structural integrity to eartip 400; thus, it does not need to be as compliant as outer eartip body 422 for conforming to the ear canal.

Outer eartip body 422 can include a curved interface surface 424 that is configured to make contact with the inner surfaces of the ear canal for forming an acoustic seal when the wireless listening device is worn by the user. Outer eartip body 422 can taper toward ear-interfacing end 412 to make it easier for the user to insert eartip 402 into his or her ear canal. In some embodiments, a part of outer eartip body 422 closest to attachment end 414 can bend back toward inner eartip body 416 to reduce the chances of outer eartip body 422 flipping inside-out.

In some embodiments, eartip 402 can include an attachment structure 408 for securely attaching to outer structure 404. As mentioned herein, eartip 402 can be formed of a compliant material such as silicone. Compliant materials may not easily attach to stiff structures alone. Thus, attachment structure 408 can be implemented to provide some rigidity for certain parts of eartip 402 to enable eartip 402 to securely attach to outer structure 404. In some embodiments, attachment structure 408 is positioned within base portion 420 and may extend into a portion of tip portion 418 closest to attachment end 414 so that attachment structure 408 can help attach eartip 402 to outer structure 404 of the housing. Attachment structure 408 can be formed of a stiff, rigid material such as plastic or thermal plastic urethane (TPU) that is strong enough to achieve the desired attachment characteristics suitable for attaching eartip 402 with outer structure 404. In some embodiments, attachment structure 408 is formed to be more rigid than inner eartip body 416 and outer eartip body 422.

Attachment structure 408 can include a mesh 409 for preventing debris and other unwanted particles from falling into the housing through acoustic opening 411. Mesh 409 can be an interlaced structure formed of a network of wire that allows sound to propagate through but prevents debris from passing through. In some embodiments, mesh 409 extends into a portion of attachment structure 408 so that mesh 409 can be securely fixed within eartip 402 by the rigid structure of attachment structure 408. Attachment structure 408 can also include a plurality of attachment features 426 that protrude out of attachment end 404 and are configured to physically couple with outer structure 404. In some instances, attachment features 426 can be separately positioned around a perimeter of attachment structure 408 so that attachment features 426 can attach to discrete locations of outer structure 404. Each attachment feature 426 can include an arm and a hook that secures to outer structure 404.

A. Grooves

Figure 5A:
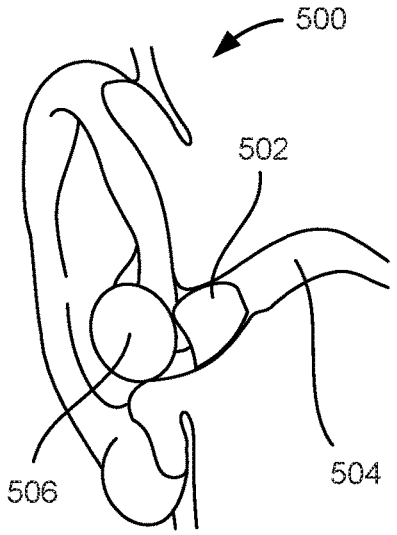
FIGS. 5A and 5B are cross-sectional view illustrations of an eartip when it is inserted into an ear canal, according to some embodiments of the present disclosure.
Figure 5B:
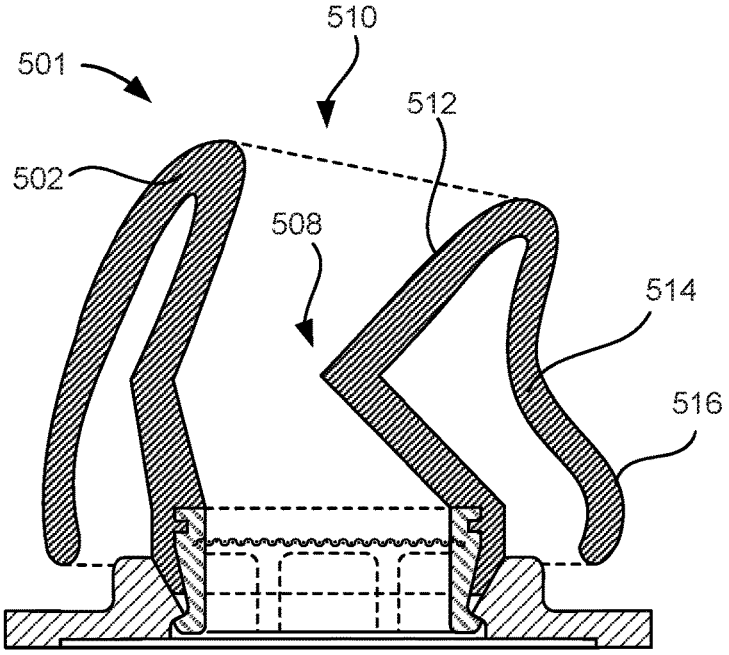

According to some embodiments of the present disclosure, an eartip can be configured so that its inner eartip body resists collapsing when the wireless listening device is worn by a user. A collapsed inner eartip body can negatively impact acoustic performance and comfort, as discussed further herein. FIGS. 5A and 5B are cross-sectional views of an eartip when it is inserted into an ear canal, where the eartip is not properly designed to fit into the ear canal. Specifically, FIG. 5A is a cross-sectional view 500 of eartip 502 relative to an ear canal 504, and FIG. 5B is a close-up cross-sectional view 501 of eartip 502 independent of ear canal 504. As shown in FIG. 5A, when inserted, eartip 502 can bend and conform to the inner surfaces of ear canal 504. Housing 506 may not bend or conform when the wireless listening device, e.g., an in-ear hearing device, is worn by the user. In some instances where eartip 502 is not properly designed to fit into the ear canal, eartip 502 can collapse and/or create pressure points which can decrease acoustic performance and user comfort, as shown in FIG. 5B.

For example, as shown in FIG. 5B, improperly designed eartip 502 can kink or sharply deform at point 508 when it is inserted into ear canal 504. When kinked, point 508 can excessively protrude into sound channel 510 and cause sound from housing 506 to reflect against inner eartip body 512 at abnormal angles and thus cause a decrease in acoustic performance. Furthermore, kinked eartip 502 can cause outer eartip body 514 to excessively bend and create pressure points in ear canal 504 when its interface surface 516 presses against surfaces of ear canal 504, which can cause discomfort.

According to some embodiments of the present disclosure, an eartip can be designed to resist kinking or sharp deformations of its inner eartip body and instead, enable a gradual and smooth bending of its inner eartip body to avoid abnormal sound reflections and provide improved acoustic performance. The gradual bending can also mitigate the creation of pressure points against the ear canal to provide improved user comfort. For instance, the eartip can be designed with a series of grooves that are designed to provide a targeted degree of bendability across a broad region of the inner eartip body so that the inner eartip body can bend without forming a kink or sharp deformation, as discussed herein with respect to FIGS. 6A-6C.

Figure 6A:
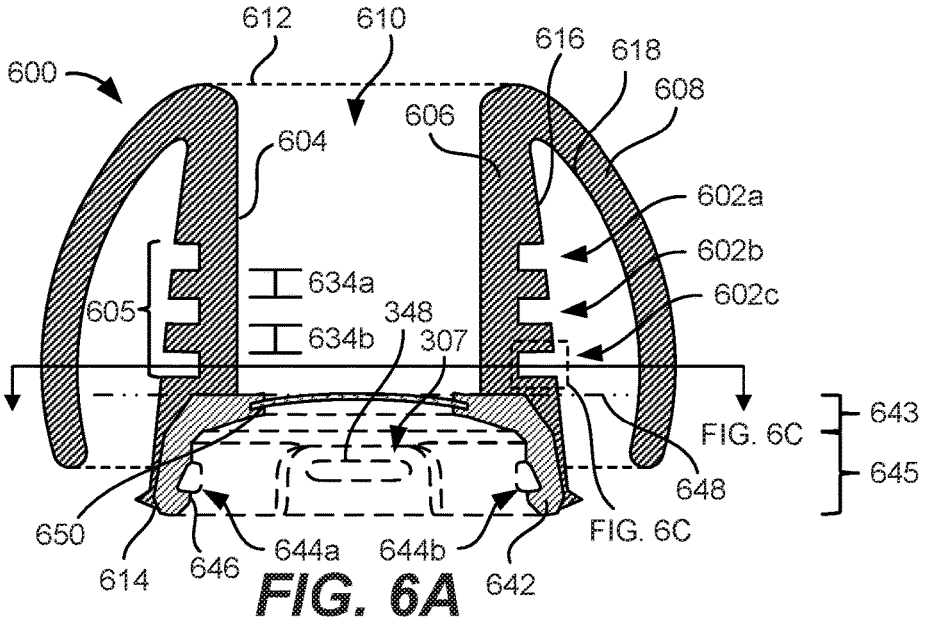
FIG. 6A is a cross-sectional view of an exemplary eartip with a plurality of grooves formed in its inner eartip body, according to some embodiments of the present disclosure.

FIG. 6A is a cross-sectional view of an exemplary eartip 600 with a plurality of grooves 602*a-c* formed in its inner eartip body 606, according to some embodiments of the present disclosure. Like eartip 400, eartip 600 can include an eartip body formed of an inner eartip body 606 and an outer eartip body 608 that together form a monolithic structure. Outer eartip body 608 can extend around a perimeter/circumference of inner eartip body 606 and during manufacturing, can initially be formed together as a deformable tube that is later folded over so that outer eartip body 608 is positioned outside of inner eartip body 606 as shown in FIG. 6A. Inner eartip body 606 can be centered along a central axis and define a sound channel 610 that extends through inner eartip body 606 between an interfacing end 612 and an attachment end 614 of the eartip body. In some embodiments, attachment end 614 can be an end of the eartip body that is configured to attach to the housing via a nozzle and a wireform attachment feature so that sound generated by the housing can pass into sound channel 610 through an acoustic opening of the housing; and, interfacing end 612 can be an end of eartip 600 opposite from attachment end 614 where outer eartip body 608 begins to extend from inner eartip body 606, such as a the top end of the eartip body.

Unlike eartip 400 in FIG. 4, however, eartip 600 can include grooves 602*a-c* positioned on an outer surface 616 of a sidewall of inner eartip body 606 facing an inner surface 618 of outer eartip body 608. The sidewall of inner eartip body 606 can be defined by a portion of inner eartip body 606 disposed between a boundary 648 and interfacing end 612. Boundary 648 can be an imaginary horizontal line positioned where inner eartip body 606 initially makes contact with attachment structure 642 as shown by a dashed and dotted line. Grooves 602*a-c* can be a series of grooves that form a bend region 605, which can be a region that controls the bending of inner eartip body 606 and mitigates the occurrence of kinking or sharp buckling when eartip 600 is inserted into an ear canal. Each groove 602*a-c* can be a recess in the outer surface 616 of inner eartip body 606 that acts as a joint to promote a predetermined degree of bending at a specific location along inner eartip body 606. While each groove can bend a small degree at a specific location, in the aggregate, grooves 602*a-c* can provide a plurality of bending points along the length of inner eartip body 606 that allows inner eartip body 606 to bend a larger degree. The spreading out and greater number of bend points can enable inner eartip body 606 to smoothly bend without kinking or sharply buckling, as shown in FIG. 6B.

Figure 6B:
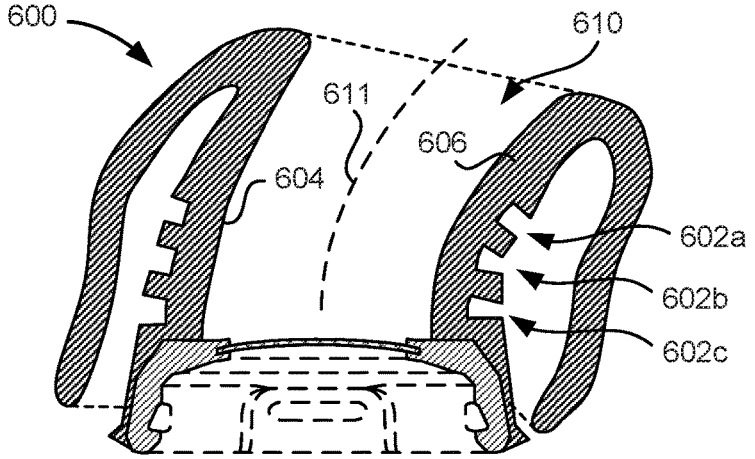
FIG. 6B is a cross-sectional view illustration of the eartip of FIG. 6A when it is inserted into an ear canal, according to some embodiments of the present disclosure.

FIG. 6B is a cross-sectional view illustration of eartip 600 when it is inserted into an ear canal, according to some embodiments of the present disclosure. Grooves 602*a-c* can provide a certain degree of bendability along bend region 605 instead of a single point. Thus, inner eartip body 606 of eartip 600 can have a large bend radius along bend line 611 that avoids kinking or sharp buckling of inner eartip body 606. The large bend radius achieved by grooves 602*a-c* can allow inner eartip body 606 to bend so that its inner surface 604 stays smooth even while bent. That way, sound channel 610 stays intact and can provide improved acoustic performance over other eartips that do not have grooves. Each groove can be designed to achieve a certain degree of bendability, as will be discussed further herein with respect to FIG. 6C.

Figure 6C:
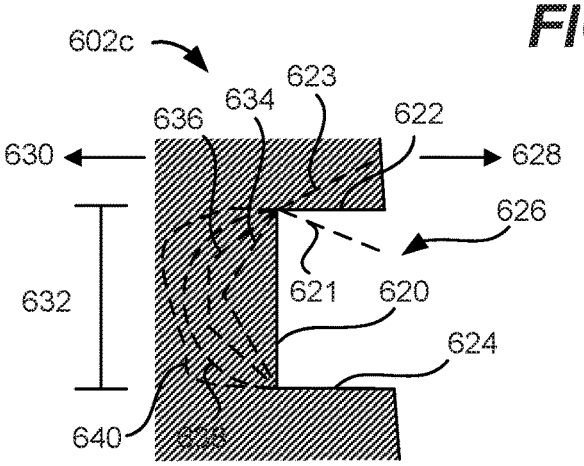
FIG. 6C is a close-up cross-sectional view of an exemplary groove, according to some embodiments of the present disclosure.

FIG. 6C is a close-up cross-sectional view of an exemplary groove, e.g., groove 602*c* in FIG. 6A, according to some embodiments of the present disclosure. Groove 602*c* can include a base wall 620 positioned between two sidewalls 622 and 624 that together define a u-shaped recess 626 formed of vacant space. Recess 626 can provide a region where sidewalls 622 and 624 can bend into when ear-interfacing end 612 bends toward direction 628 (i.e., the direction groove 602*c* is facing) to fit in an ear canal. Conversely, recess 626 can provide a joint where sidewalls 622 and 624 bend away from one another when ear-interfacing end 612 bends toward direction 630 (i.e., opposite of the direction groove 602*c* is facing). In some embodiments, base wall 620 is perpendicular to sidewalls 622 and 624, as shown in FIG. 6A, when eartip 600 is not in an ear canal. However, embodiments are not limited to such configurations and that base wall 620 and sidewalls 622 and 624 can form respective acute or obtuse angles according to design.

Configuring base wall 620 and sidewalls 622 and 624 at acute angles, e.g., side wall configuration 621, decreases the maximum bend angle when sidewalls 622 and 624 bend into recess 626 because sidewalls 622 and 624 may travel a shorter distance before running into one another when compared to a perpendicular arrangement, thereby resulting in a maximum bend angle for the inner eartip body that is less than that of the parallel configuration. Conversely, configuring base wall 620 and sidewalls 622 and 624 at obtuse angles, e.g., side wall configuration 623, increases the maximum bend angle when sidewalls 622 and 624 bend into recess 626 because sidewalls 622 and 624 may travel a longer distance before running into one another when compared to a perpendicular arrangement, thereby resulting in a maximum bend angle for the inner eartip body that is greater than that of the parallel configuration. The maximum degree to which eartip 600 as a whole can bend may depend on the combined maximum bend angles of all grooves. Thus, the more each groove can bend, the more eartip 600 can bend as a whole.

In addition to the angle between base wall 620 and sidewalls 622 and 624, other parameters of grooves 602*a-c* can be modified to alter the bend angle of eartip 600. For instance, each groove can have a groove length 632 that spans across the length of base wall 620. Longer groove lengths 632 can increase the maximum bend angle when sidewalls 622 and 624 bend into recess 626 because sidewalls 622 and 624 may be farther apart and thus may need to travel a longer distance before running into one another when compared to shorter groove lengths 632. Shorter groove lengths 632 can decrease the maximum bend angle when sidewalls 622 and 624 bend into recess 626 because sidewalls 622 and 624 may be closer together and thus may need to travel a shorter distance before running into one another when compared to longer groove lengths 632. Accordingly, those eartips designed with grooves having longer groove lengths 632 can achieve a greater degree of bending than that of other eartips designed with grooves having shorter groove lengths 632.

In further addition to groove length 632 and the angle between base wall 620 and sidewalls 622 and 624, separation distances between each groove 602*a-c* can be modified to achieve a certain bend radius. For instance, grooves 602*a-c* can be separated by separation distances 634*a-b*, as shown in FIG. 6A. Larger separation distances 634*a-b* can result in longer bend regions 605 and thus larger bend radiuses. Smaller separation distances 634*a-b* can result in shorter bend regions 605 and thus smaller bend radiuses. In some embodiments, separation distances 634*a-b* can be larger than the groove length of one or more grooves 602*a-c*. In some additional and alternative embodiments, separation distances 634*a-b* can be smaller than or equal to the groove length of one or more grooves 602*a-c*.

It is to be appreciated that the angles defined by base wall 620 and sidewalls 622 and 624, in conjunction with groove lengths and separation distances, can allow eartips discussed herein to achieve a wide range of bend angles and bend radiuses. Specific ranges of bend angles and bend radiuses can be tailored according to design by configuring the angles, lengths, and distances discussed above. Accordingly, eartips of the present disclosure can be tuned to achieve a proper fit with at least 95% of the user population. Although discussions with respect to FIG. 6C relate to groove 602*c*, it is to be appreciated that the discussions equally apply to grooves 602*a-b*.

Although FIG. 6C shows base wall 620 as being substantially flat and vertical, embodiments are not so limited in that other embodiments can have modified base walls that have different profiles. For instance, base wall 620 can have a half-diamond profile 634 where base wall 620 is formed of two flat surfaces at different angles with respect to true north. The two surfaces can meet at one point in the center of base wall 620. In another example, base wall 620 can have a half-hexagonal profile 636 where base wall 620 is formed of three flat surfaces at different angles with respect to true north. The center surface can be substantially vertical, i.e., parallel to true north, in such embodiments. In yet another example, base wall 620 can have a curved profile 638 where base wall 620 is formed of a curved surface. The curved surface can be a concave surface that follows the profile of a circle or an oval, and any other curved surface. Although the different profiles shown in FIG. 6C are symmetrical across a horizontal axis, embodiments are not limited to such configurations. In some embodiments, base wall 620 can have an amorphous profile 640 that is not symmetrical across a horizontal axis and have various curved surfaces of varying degrees of curvature.

Figure 6D:
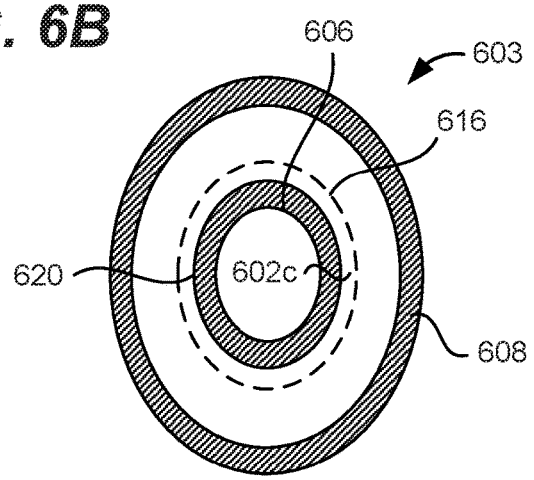
FIG. 6D is a top-down, cross-sectional view of an eartip across a horizontal plane that intersects a groove, according to some embodiments of the present disclosure.

In some embodiments, each groove 602*a-c* can extend along the entire perimeter of inner eartip body 606 so that eartip 600 can bend in any direction without kinking. For instance, FIG. 6D is a top-down, cross-sectional view 603 of eartip 600 across a horizontal plane that intersects groove 602*c*, according to some embodiments of the present disclosure. Eartip 600 is shown with a circular cross-sectional profile but embodiments are not limited to such configurations. Some eartips can have oval or oblong cross-sectional profiles in other embodiments as shown in FIG. 3B herein. With reference to FIG. 6C, groove 602*c*, and grooves 602*a-b* even though they are not shown in FIG. 6C, can have an ovular structure that extends along a circumference of inner eartip body 606. The outer surface of inner eartip body 606 is shown as a dotted line to indicate its position relative to bottom wall 620 of groove 602*c*. By being formed with ovular profiles, grooves 602*a-c* can be have a corresponding ovular profile and provide improved bendability and resistance to kinking for eartip 600 in all directions. This may help eartip 600 more easily fit into ear canals by requiring less force to bend along the ear canal profile, which can further improve usability and comfort. In instances where eartip 600 has a circular profile, grooves 602*a-c* can have annular profiles that also provide the improved bendability and resistance to kinking for eartip 600 equally in all directions.

Although FIG. 6D illustrates grooves extending around an entire circumference of an inner eartip body, other embodiments are not so limited and can have grooves that extend around a portion of the inner eartip body. That way, only specific portions of the eartip can have the bendability provided by the grooves. This may be particularly useful in instances where the eartip is ovular and is more likely to bend along its long axis than its short axis. In such cases, grooves can extend around a portion of the inner eartip body positioned on a region of the outer surface along the long axis.

The thickness of an inner eartip body of an eartip can affect the bendability of the eartip. Thicker inner eartip bodies can require more force to bend the eartip, while thinner inner eartip bodies can require less force. Thus, thicker inner eartip bodies can resist deformation more than thinner inner eartip bodies, thereby causing the eartip to feel harder and potentially more uncomfortable to the user. In some embodiments, the inner eartip body of an eartip can have a thickness that is substantially constant across its length, as shown in FIG. 4. In such configurations, the eartip may have the same feel and firmness to it regardless of where it bends. However, in some other embodiments, the inner eartip body can have varying thicknesses to achieve a softer feel in some parts of the eartip and firmness in other parts. For instance, with reference to FIG. 6A, inner eartip body 606 can have a thickness that gradually changes from ear-interfacing end 612 to attachment end 614. In certain embodiments, the thickness of inner eartip body 606 can gradually increase from ear-interfacing end 612 to attachment end 614 so that eartip 600 can have varying degrees of mechanical compliance at different points along its length. For instance, having a thinner inner eartip body near ear-interfacing end 612 (i.e., the end that inserts into an ear canal) gives eartip 606 a more soft and comfortable construction, while having a thicker inner eartip body near attachment end 614 gives eartip 606 a firmer construction that provides more structural rigidity for attaching to a housing. This allows eartip 600 to achieve a robust attachment to the housing without compromising its soft, comfortable feel for the user.

In such embodiments where the thickness of inner eartip body 606 varies, the sidewalls of each groove can have different lengths to follow the slanted profile of outer surface 616 of inner eartip body 606. As an example, the length of sidewall 622 in FIG. 6C can be shorter than the length of sidewall 624, while base wall 620 is substantially vertical. Furthermore, in certain embodiments, the depth of grooves 602*a-c* can vary along with the thickness of inner eartip body 606. For example, grooves closest to ear-interfacing end 612 (e.g., groove 602*a*) can have shallower depths than grooves farther from ear-interfacing end 612 (e.g., grooves 602*b-c*). Thus, in some embodiments, the sidewall lengths of grooves closest to ear-interfacing end 612 can be shorter than those of grooves farther from ear-interfacing end 612. Such configurations may have the same inner eartip body 606 thickness at regions proximate to the base walls of grooves 602*a-c*, as shown in FIG. 6A. Alternatively, grooves

602*a-c* can have the same depths. In such instances, grooves 602*a-c* can have the same sidewall lengths. By having the same depths, each groove can bend the same degree.

With reference back to FIG. 6A, in some embodiments, eartip 600 can include an attachment structure 642 for coupling with a housing. Attachment structure 642 can include an upper region 643 and a lower region 645 that extends from upper region 643. Upper region 643 can have a more horizontal disposition than lower region 645, which may be more vertical than upper region 643, thereby being an inverted u-shaped profile as shown. Unlike attachment structure 408 in FIG. 4 which has features that actively grip onto the housing, attachment structure 642 instead includes recesses 644*a-b* around lower region 645 for providing latching points for an attachment mechanism to attach. Recesses 644*a-b* can be cavities defined by an inner surface 646 of lower region 645 of attachment structure 642 that passively allow an attachment mechanism to secure eartip 600 to a housing. For instance, portions of the lower region below recesses 644*a-b* can form an inverted overhang structure that hooks onto an external structure, such as an end cap of an attachment structure. Inner eartip body 606 can interface with attachment structure 642 at boundary 648.

Attachment structure 642 can be formed of a different and stiffer material than what is used to construct the eartip body. Attachment structure 642 can be formed of a stiffer material so that its rigidity can be more suitable for attaching to the housing. Eartip 600 can also include a mesh 650 for preventing debris and other unwanted particles from falling completely through sound channel 610. Mesh 650 can be a soft, porous fabric that allows sound to propagate through but prevents debris from passing through. For instance, mesh 650 can be formed of a polyester fabric. In some embodiments, mesh 650 extends into upper region 643 of attachment structure 642 so that mesh 650 can be securely fixed within eartip 600 by the rigid structure of attachment structure 642.

Figure 7A:
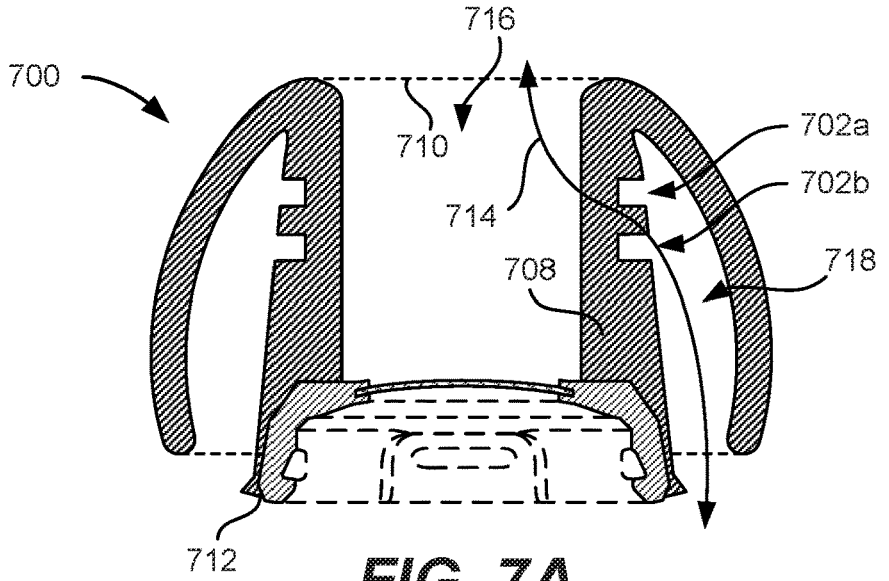
FIGS. 7A-7C are cross-sectional views of exemplary eartips having different configurations of grooves, according to some embodiments of the present disclosure.
Figure 7B:
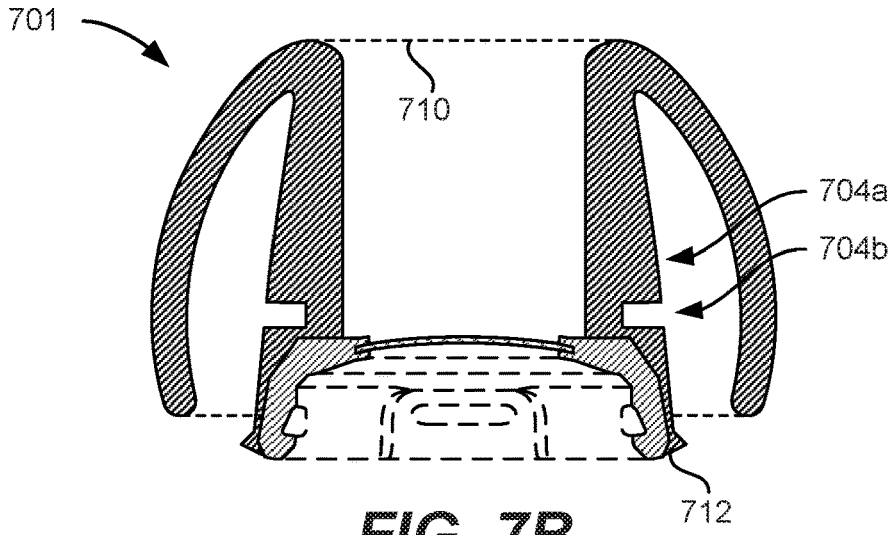
Figure 7C:
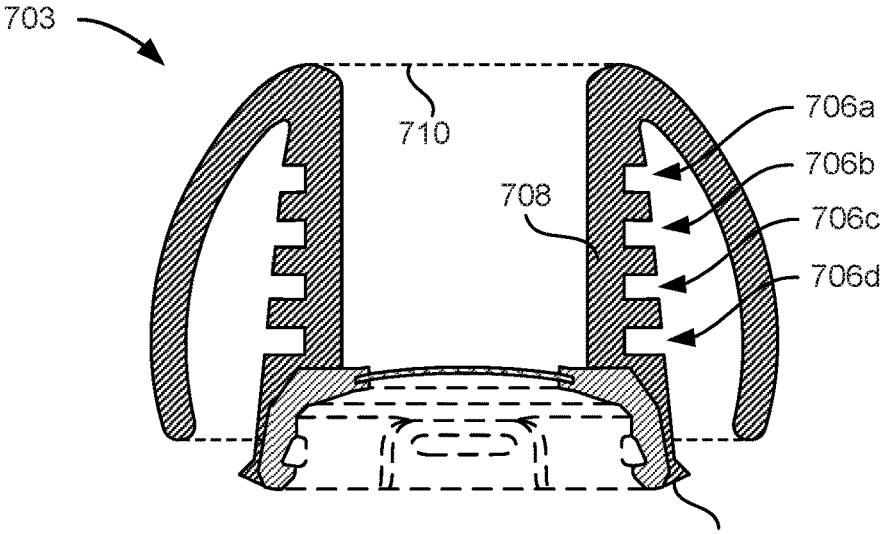

Although FIG. 6A shows an eartip having three grooves positioned near the bottom of the inner eartip body, embodiments are not limited to such configurations and that eartips having any number of grooves positioned along any region of the length of the inner eartip body are envisioned herein without departing from the spirit and scope of the present disclosure. FIGS. 7A-7C are cross-sectional views of exemplary eartips having different configurations of grooves, according to some embodiments of the present disclosure. In some embodiments, an eartip 700 in FIG. 7A can have two grooves 702*a-b* that are positioned closer to ear-interfacing end 710 than attachment end 712. Accordingly, the bend region can be near ear-interfacing end 710 and can allow eartip 700 to bend to fit the profile of an ear canal without kinking or sharply deforming. Although FIG. 7A shows grooves 702*a-b* closer to ear-interfacing end 710 than attachment end 712, embodiments can have grooves 702*a-b* closer to attachment end 712 than ear-interfacing end 710. In some additional or alternative embodiments, an eartip 701 in FIG. 7B can have a single groove 704 that is positioned closer to attachment end 712 than ear-interfacing end 710. Accordingly, the bend region can be near attachment end 712 and allow eartip 701 to bend to fit the profile of an ear canal without kinking or sharply deforming. And, in some additional or alternative embodiments, an eartip 703 in FIG. 7C can have four grooves 706*a-d* that are positioned along the entire length of inner eartip body 708 between attachment end 712 and ear-interfacing end 710. Thus, the entire length of eartip 700 can bend to fit the profile of an ear canal without kinking or sharply deforming.

B. Internal Sound Sealing Structures

As disclosed herein, a plurality of grooves can be formed along a region of an inner eartip body of an eartip to promote bending without kinking or sharply deforming. By forming the grooves, the thickness of the region of the inner eartip body where the grooves are positioned may be thinner than regions where grooves are not present. For instance, with brief reference back to FIG. 7A, the region where grooves 702*a-b* are positioned may be thinner than other regions of inner eartip body 708. The thin regions may sometimes allow sound 714 to travel between sound channel 716 and deflection zone 718, thereby causing interference and/or a decrease in acoustic performance. As an example, ambient noise existing in the surrounding environment can leak through the thin region and into sound channel 716 from deflection zone 718 of eartip 700 and be heard by the user as interference, e.g., pink noise. Furthermore, sound outputted to the user from the housing through sound channel 716 can leak through the thin region and into the atmosphere through deflection zone 718, thereby attenuating the audio output from the housing and reducing the acoustic performance of the system. According to some embodiments of the present disclosure, one or more internal sealing structures can be implemented to prevent and/or mitigate the transmission of this interference to the user. The internal sealing structure can be any suitable structure configured to seal the deflection zone from atmosphere when the eartip is inserted into an ear canal, as will be discussed further herein.

Figure 8A:
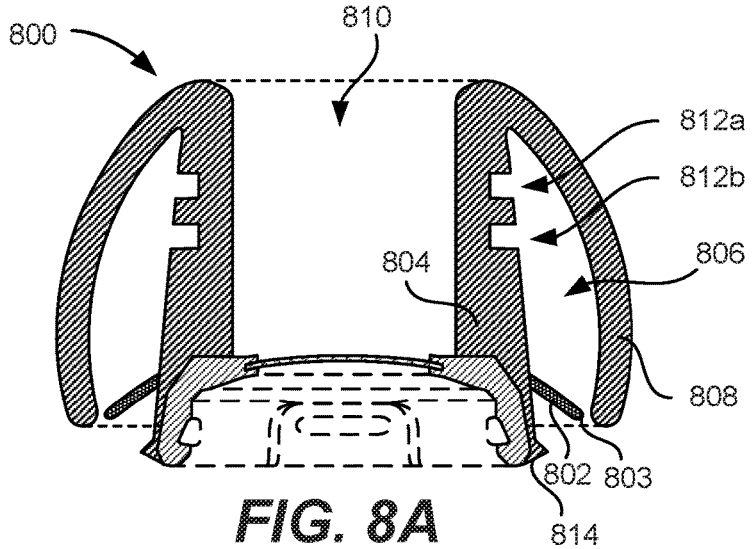
FIGS. 8A-8E is a cross-sectional view of an exemplary eartip configured with different internal sound outer eartip bodies, according to some embodiments of the present disclosure.

FIG. 8A is a cross-sectional view of an exemplary eartip 800 configured with an internal sound outer eartip body 802, according to some embodiments of the present disclosure. Internal sound outer eartip body 802 can be an annular or ovular shaped flange that extends around, and be directly attached to, an entire circumference of inner eartip body 804. Internal sound outer eartip body 802 can also include an end 803 that extends into deflection zone 806 toward outer eartip body 808. In some embodiments, internal sound outer eartip body 802 can extend at a downward angle as shown in FIG. 8A toward attachment end 814. End 803 can freely suspend in space and be separated from outer eartip body 808 when eartip 800 is not inserted into an ear canal. However, when eartip 800 is inserted into an ear canal, outer eartip body 808 may make contact with internal sound outer eartip body 802 and form a seal that seals deflection zone 806 from the atmosphere. That way, sound can be prevented from leaking between sound channel 810 and deflection zone 806 through the thin regions of inner eartip body 804 where grooves 812*a-b* are positioned, thereby mitigating interference and improving acoustic performance. In some embodiments, internal sound outer eartip body 802 is positioned closer to attachment end 814 than all of the grooves, e.g., grooves 812*a-b*. Furthermore, in certain embodiments, internal sound outer eartip body 802 can be an extension of inner eartip body 804 such that inner eartip body 804 and internal sound outer eartip body 802 form a monolithic structure. However, in other embodiments, internal sound outer eartip body 802 and inner eartip body 804 can be independent structures where internal sound outer eartip body 802 is attached to inner eartip body 804 by an adhesive (not shown) or any other suitable means, e.g., mechanical fastening, geometric fastening, static friction, and the like.

It is to be appreciated that although FIG. 8A shows an internal sealing structure formed of a single flange extending from the inner eartip body and into the deflection zone, embodiments are not limited to such configurations. Other embodiments can have internal sealing structures formed of more than one flange and/or attached to different parts of the eartip, or they can be formed of an inner eartip body, as discussed herein with respect to FIGS. 8B-8E.

Figure 8B:
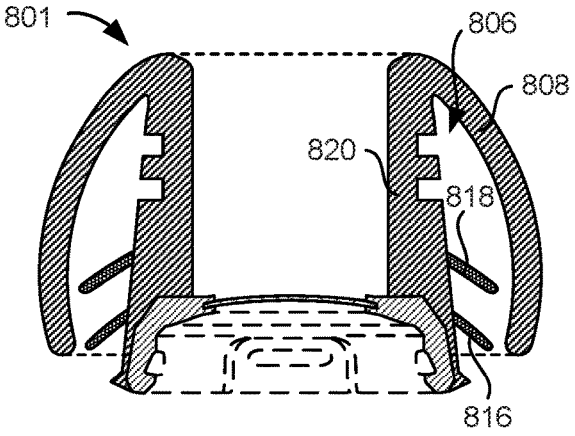

FIGS. 8B-8E illustrate several eartips having internal sound sealing structures that are configured in different ways, according to some embodiments of the present disclosure. For instance, FIG. 8B illustrates an exemplary eartip 801 that includes a plurality of internal sound outer eartip bodies, e.g., flanges 816 and 818. Like internal sound outer eartip body 802, both outer eartip bodies 816 and 818 can be annular or ovular structures that extend into deflection zone 806 toward outer eartip body 808 at a downward angle. Furthermore, both outer eartip bodies 816 and 818 can extend around, and be attached to, an entire circumference of inner eartip body 820.

Figure 8C:
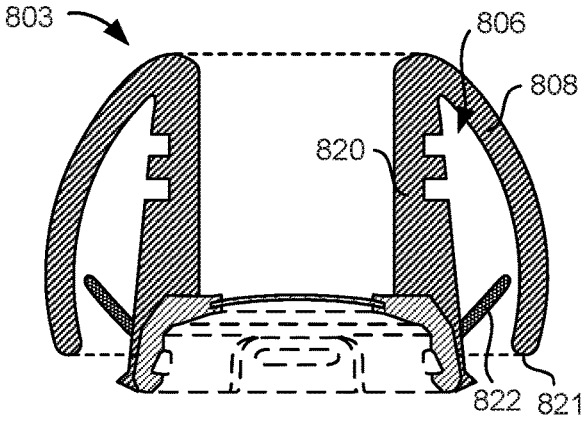

In some embodiments, internal sound sealing structures may be flanges that extend upward. For instance, FIG. 8C illustrates an exemplary eartip 803 that includes an internal sound outer eartip body 822 that, like internal sound outer eartip body 802 in FIG. 8, can be an annular or ovular structure that extends into deflection zone 806 toward outer eartip body 808; and it can also extend around, and be attached to, an entire circumference of inner eartip body 820. However, unlike flange 802, internal sound outer eartip body 822 can extend at an upward angle, as shown in FIG. 8C. Extending at an upward angle can ensure that flange 822 does not slide so far along outer eartip body 808 that it ends up extending below a bottom end 821 of outer eartip body 808.

Figure 8D:
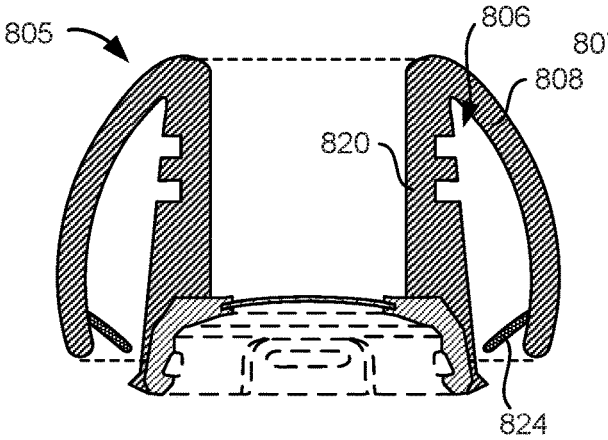

Although embodiments discussed herein with respect to FIGS. 8B-8C have internal sound outer eartip bodies that extend from, and are directly attached to, the inner eartip body, embodiments are not limited to such configurations. For instance, FIG. 8D illustrates an exemplary eartip 805 that includes an internal sound outer eartip body 824 that, like internal sound outer eartip body 802, can be an annular or ovular structure that extends into deflection zone 806 at a downward angle, as shown in FIG. 8D. However, unlike flange 802, internal sound outer eartip body 822 can extend around, and be directly attached to, an entire inner circumference of outer eartip body 808. Flange 822 can also extend toward inner eartip body 820.

Figure 8E:
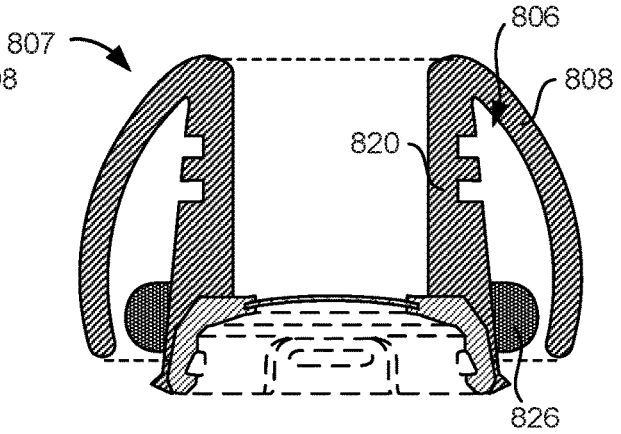

It is to be appreciated that while an internal sound sealing structure can be formed of a flange that contacts another structure form a seal, embodiments are not limited to such configurations. For instance, some embodiments can be formed of other structures for forming a seal without departing from the spirit and scope of the present disclosure. FIG. 8E illustrates an exemplary eartip 807 that includes an internal sound sealing structure that is formed of an annular bulbous structure 826, according to some embodiments of the present disclosure. Bulbous structure 826 can include a flat surface that attaches to inner eartip body 820 and a convex surface that extends toward outer eartip body 808, as shown in FIG. 8E. Bulbous structure 826 can be an extension of inner eartip body 820 such that structure 826 and inner eartip body 820 form a monolithic structure. Alternatively, bulbous structure 826 and inner eartip body 820 are independent structures where bulbous structure 826 is attached to inner eartip body 820. Bulbous structure 826 can be formed of any suitable material that can form a seal between inner eartip body 820 and outer eartip body 808. For instance, bulbous structure 826 can be formed of a sticky material that can securely, but temporarily, stick to outer eartip body 808 when eartip 807 is inserted into an ear canal. In another instance, bulbous structure 826 can be formed of a soft and malleable material with a lower density and durometer than the material used to form inner eartip body 820 and/or outer eartip body 808. The contact formed between bulbous structure 826 and both inner eartip body 820 and outer eartip body 808 can form an acoustic seal. In certain embodiments, the material used to formed bulbous structure 826 can be different from the material used to form inner eartip body 820 and/or outer eartip body 808. In some alternative embodiments, bulbous structure 826 may be laterally flipped and directly attached to outer eartip body 808 instead, similar to the configuration shown in FIG. 8D for internal sound outer eartip body 824.

In some other embodiments, an internal sound sealing structure (not shown) can be permanently attached between the inner eartip body and the outer eartip body to permanently seal the deflection zone (as well as the sound channel) from the atmosphere. In such instances, the internal sound outer eartip body can be formed of a soft and compliant material that can easily collapse to allow the outer eartip body to deflect into the deflection zone when the eartip is worn. Alternatively, a compliant, foam-like material can completely fill in the vacant space in the deflection zone. The foam-like material can prevent sound from leaking between the sound channel and the deflection zone through the thinner wall of the inner eartip body.

C. Coil Guide

Although FIGS. 6A-6D, 7A-7C, and 8A-8E illustrate exemplary eartips having grooves formed in the inner eartip body, embodiments are not limited to such configurations to mitigate kinking in the inner eartip body. For instance, a coil guide can be implemented by an eartip to help guide the bending motion of the inner eartip body and mitigate kinking, as discussed herein with respect to FIGS. 9A-9D.

Figure 9A:
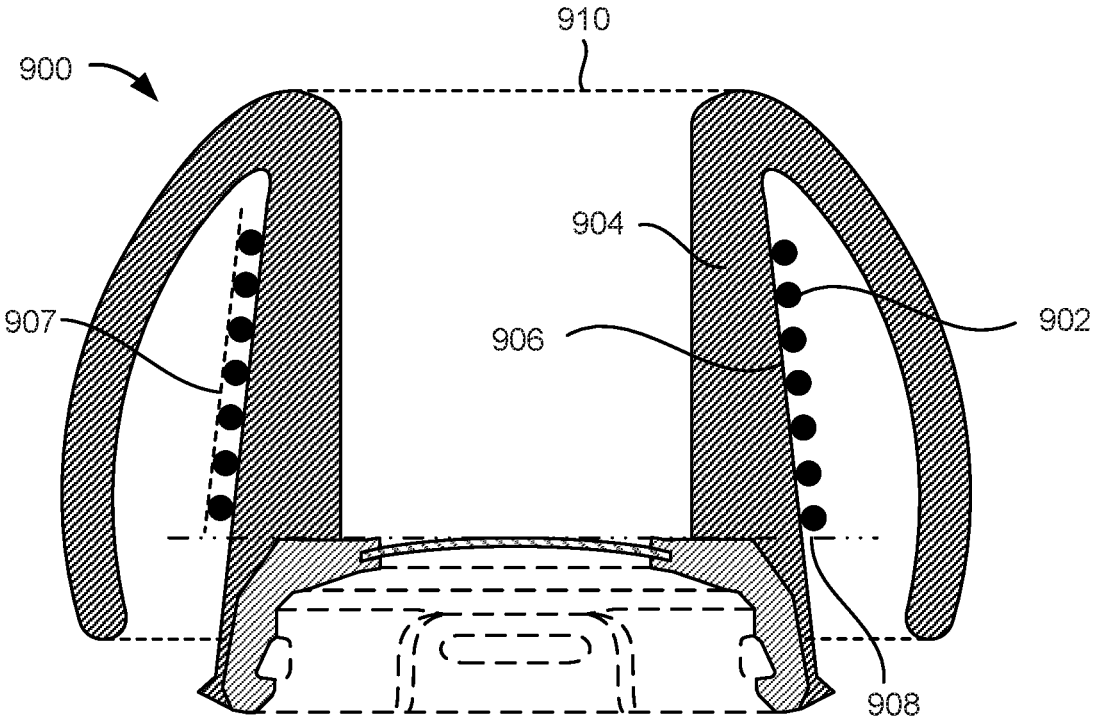
FIGS. 9A-9D are simplified cross-sectional views of exemplary eartips implemented with coil guides for mitigating kinking, according to some embodiments of the present disclosure.

FIGS. 9A-9D are simplified cross-sectional views of exemplary eartips implemented with coil guides for mitigating kinking, according to some embodiments of the present disclosure. As shown in FIG. 9A, an eartip 900 can include a coil guide 902 wound around an inner eartip body 904 of eartip 900. Coil guide 902 can be a strand of wire wound into a spiral shape positioned outside of inner eartip body 904. In some embodiments, coil guide 902 can contact an outer surface 906 of inner eartip body 904 and be positioned on the sidewall of inner eartip body 904 between a boundary 908 and an interfacing end 910 of eartip 900. Boundary 908 and interfacing end 910 are similar to boundary 648 and interfacing end 612 discussed herein with respect to FIG. 6A and are thus not discussed here for brevity. In some embodiments where inner eartip body 904 has a varying sidewall thickness between boundary 908 and interfacing end 910, coil guide 902 can be conical in shape and thus have turns near boundary 908 that have larger diameters than turns near interfacing end 910. Each consecutive turn from a turn closest to boundary 908 to a turn closest to interfacing end 910 can decrease in diameter and at a same degree of difference across all turns, thereby forming a conical shape with an angled and linear tangential profile 907 extending along a height of coil guide 902. That way, coil guide 902 conforms to the tapering profile of the sidewall of inner eartip body 904.

Figure 9B:
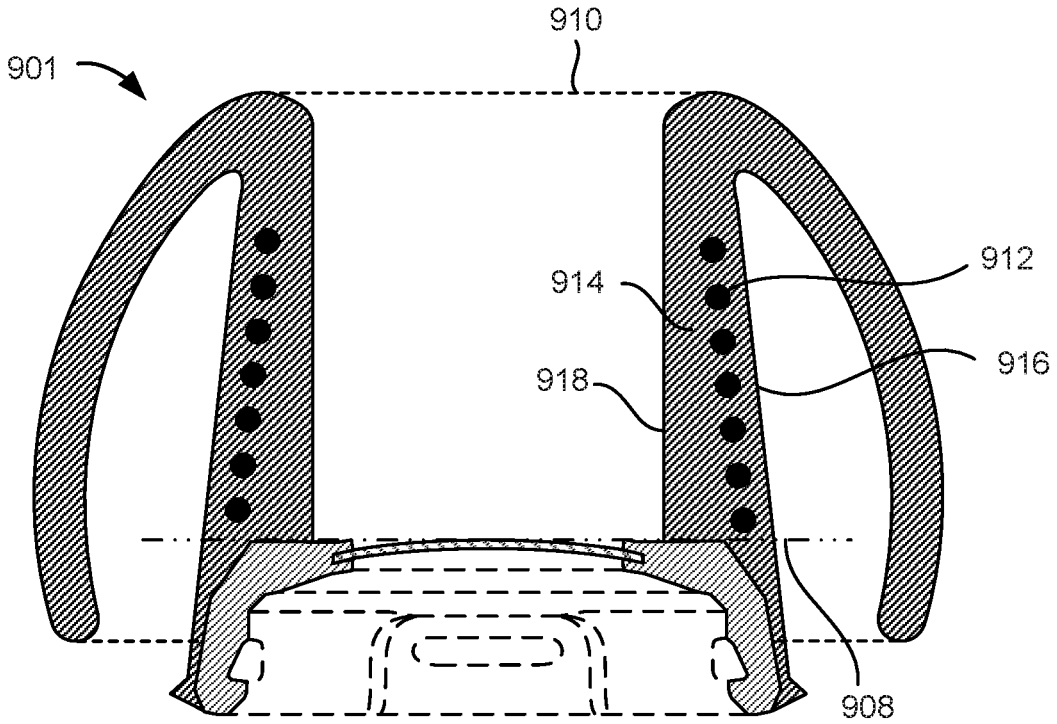

As shown in FIG. 9B, an exemplary eartip 901 can have a coil guide 912 embedded within a sidewall of inner eartip body 914. Like coil guide 902, coil guide 912 can be conical in shape and thus have turns near boundary 908 that have larger diameters than turns near interfacing end 910. In some embodiments, coil guide 912 can be positioned closer to an outer surface 916 of the sidewall of inner eartip body 914 than an inner surface 918 of inner eartip body 914.

Figure 9C:
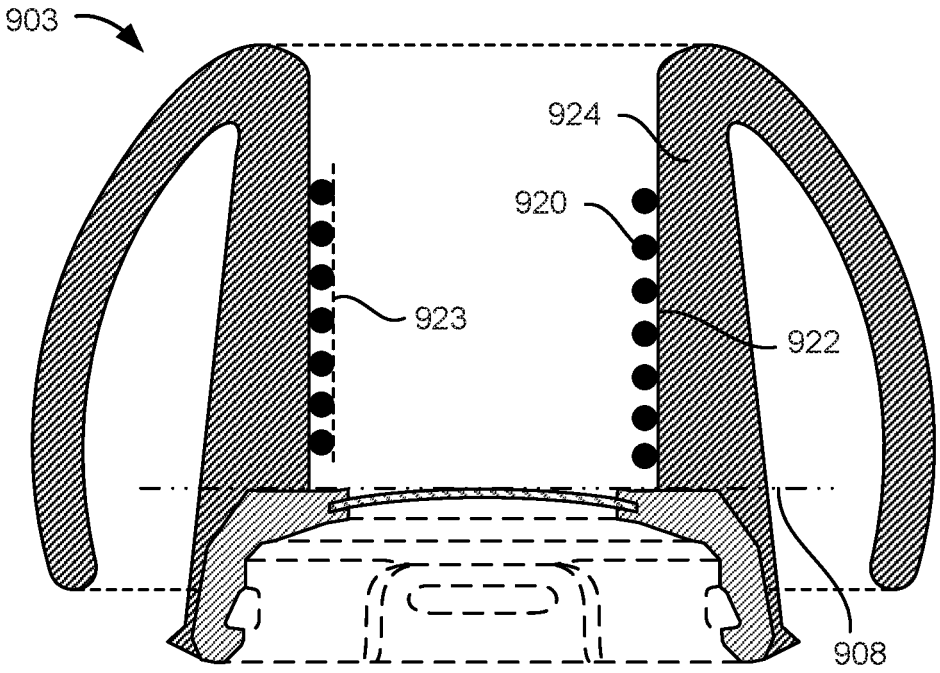

Although FIGS. 9A-9B show embodiments where coil guides have conical shapes and are positioned on outer surfaces of, and within, the inner eartip body, embodiments are not so limited. Other embodiments can have substantially cylindrical shapes and be positioned on inner surfaces of, and within, the inner eartip body. For instance, as shown in FIG. 9C, an exemplary eartip 903 can include a coil guide 920 positioned on an inner surface 922 of a sidewall of an inner eartip body 924. Coil guide 920 can be substantially cylindrical in shape and thus all of the turns of coil guide 920 can have equal diameters. That is, all the turns of coil guide 920 can have the same diameter, thereby forming a cylindrical shape with a vertical and linear tangential profile 923 extending along a height of coil guide 920.

Figure 9D:
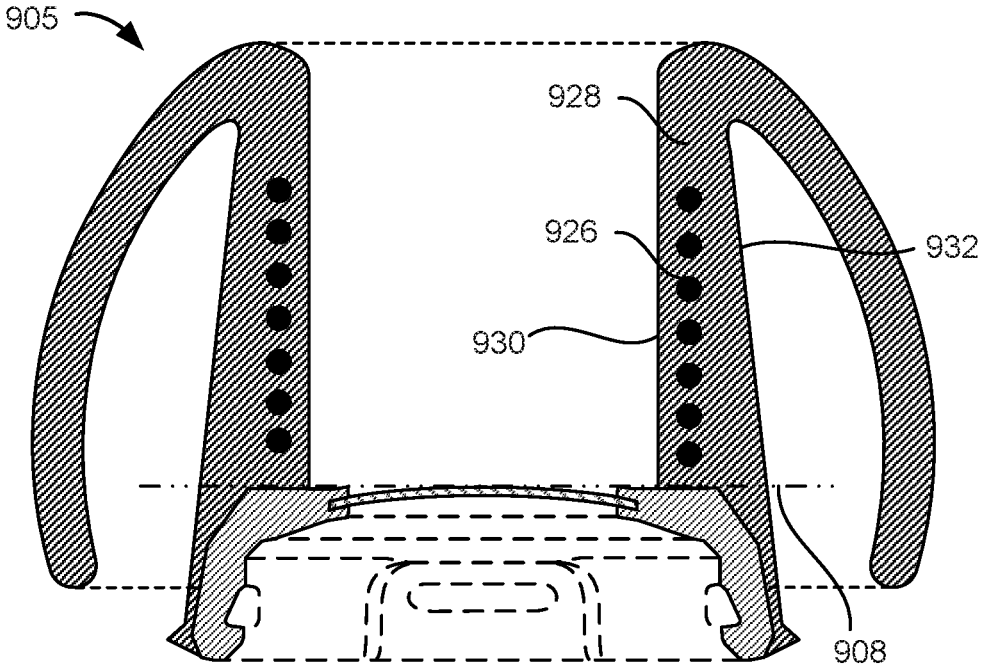

As shown in FIG. 9D, an exemplary eartip 905 can have a coil guide 926 embedded within a sidewall of an inner eartip body 928. Like coil guide 920, coil guide 926 can be cylindrical in shape and thus all the turns can have equal diameters. In some embodiments, coil guide 926 can be positioned closer to an inner surface 930 of the sidewall of inner eartip body 928 than an outer surface 932 of inner eartip body 928.

By incorporating a coil guide into eartips, inner eartip bodies may have more structural rigidity yet have a sufficient degree of bendability to bend and conform to the profile of an ear canal while being more resistant to kinking.

D. Support Structures

When inserted into an ear canal, the outer eartip body can conform to the inner surfaces of the ear canal and form a seal. Some surfaces of the ear canal can cause the outer eartip body to unevenly press against the ear canal, which can create pressure points and cause discomfort. Additionally, only a small portion of the outer eartip body may make contact with the ear canal, thereby forming a weak seal that can allow noise from the environment to interfere with sound outputted by the housing. Thus, according to some embodiments of the present disclosure, one or more support structures can be implemented to resist uneven deformation of the outer eartip body so that pressure is spread evenly across the inner surface of the ear canal, thereby mitigating the creation of pressure points to improve comfort and acoustic seal, as will be discussed further herein.

Figure 10A:
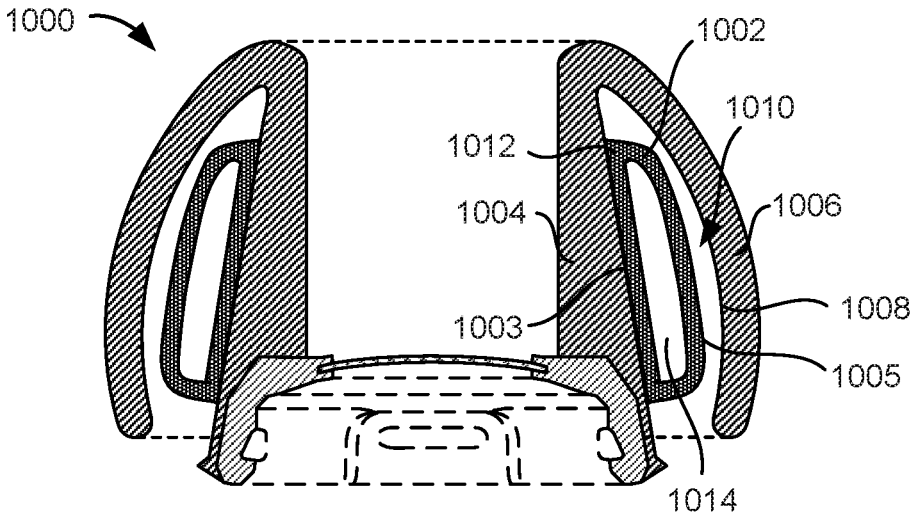
FIG. 10A is a cross-sectional view of an exemplary eartip with a support structure configured as an annular or ovular balloon, according to some embodiments of the present disclosure.

FIG. 10A is a cross-sectional view of an exemplary eartip 1000 with a support structure 1002 configured as an annular or ovular balloon, according to some embodiments of the present disclosure. Support structure 1002 can include a contact surface 1005 and a flat surface 1003 that attaches to, and around the entire circumference of, inner eartip body 1004. Contact surface 1005 can be curved, as shown in FIG. 10A, or any other suitable contour, such as straight or angled, without departing from the spirit and scope of the present disclosure. Support structure 1002 can be configured so that when eartip 1000 is not inserted into an ear canal, support structure 1002 may not make contact with inner surface 1008 of outer eartip body 1006, but does make contact when eartip 1000 is inserted into an ear canal. In some embodiments, at least a portion of contact surface 1005 is configured to make contact with outer eartip body 1006 when eartip 1000 is inserted into an ear canal. When inserted, support structure 1002 can be designed to resist the complete collapse of outer eartip body 1006 of eartip 1000. Support structure 1002 can resist the collapse by pressing against an inner surface 1008 of outer eartip body 1006 along a force vector opposite to that applied by the ear canal to deflect outer eartip body 1006 into deflection zone 1010, which is better shown in FIG. 10B.

Figure 10B:
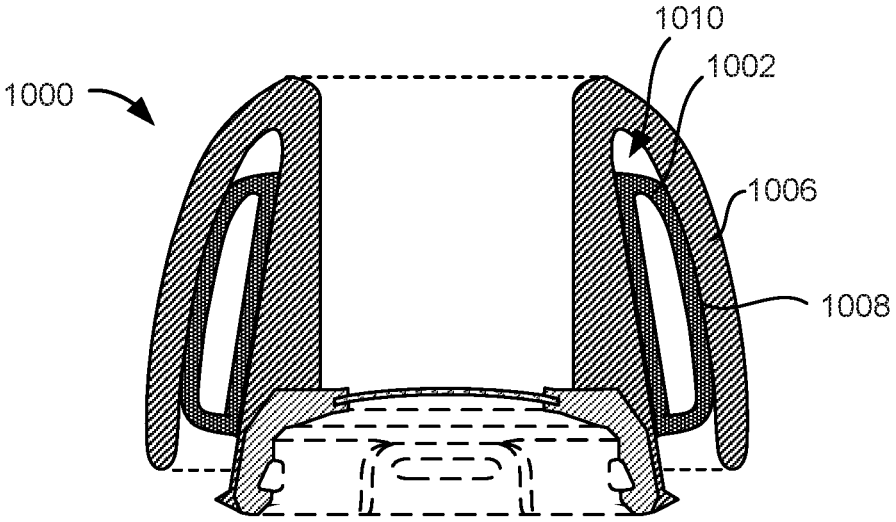
FIG. 10B is a cross-sectional view of the eartip in FIG. 10A after it has been inserted into an ear canal, according to some embodiments of the present disclosure.

FIG. 10B is a cross-sectional view of eartip 1000 with support structure 1002 after it has been inserted into an ear canal, according to some embodiments of the present disclosure. When outer eartip body 1006 deflects into deflection zone 1010, support structure 1002 can resist the deflection of inner surface 1008 of outer eartip body 1006 and press against flat surface 1003 to evenly spread out the resisting pressure across a majority of inner surface 1008. That way, outer eartip body 1006 can resist small bends that form pressure points against an ear canal, which can cause discomfort to a user. To enable the spreading of pressure across inner surface 1008 of outer eartip body 1006, support structure 1002 can be configured to make contact with a majority (i.e., greater than half) of a surface area of inner surface 1008. One way to do this is to have a broad contact surface 1005. Accordingly, support structure 1002 can have an elongated structure that is attached to a majority of a length of inner eartip body 1004, as shown in FIGS. 10A and 10B.

In some embodiments, support structure 1002 is formed as a balloon including a shell 1012 that defines an inner region 1014. Shell 1012 can be formed of any suitable compliant material, such as silicone. Shell 1012 and inner eartip body 1014 can form a monolithic structure in some embodiments, or be formed of independent structures that are attached via an adhesive, mechanical fastener, geometric fastener, static friction, and the like in other embodiments. Inner region 1014 can be vacant space that is filled with air, or any other suitable material such as a liquid (e.g., water, oils, and the like) or a porous and compliant structure (e.g., foam or honeycomb material). To help resist the total collapse of outer eartip body 1006, one or more reinforcement components can be implemented in support structure 1002, as shown in FIGS. 11A and 11B.

Figure 11A:
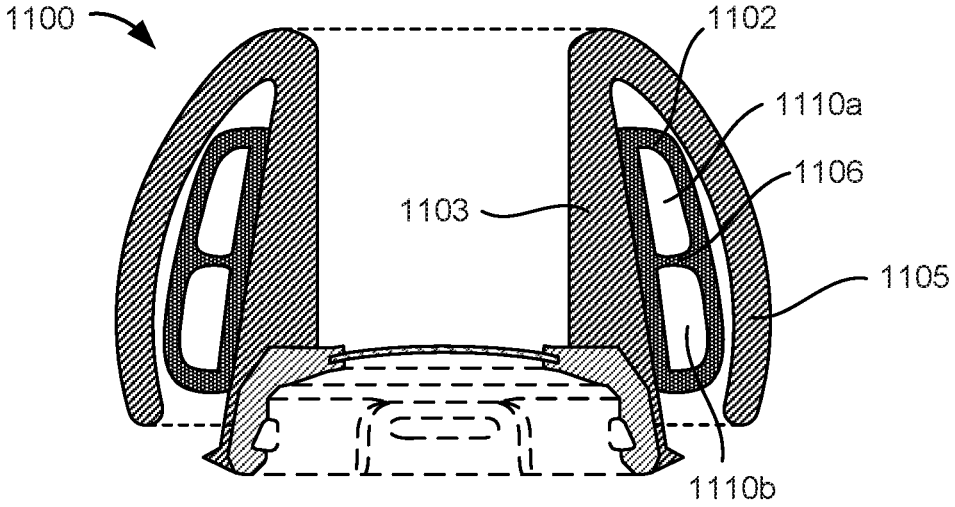
FIGS. 11A-11B are cross-sectional views of exemplary eartips including support structures having reinforcement components, according to some embodiments of the present disclosure.
Figure 11B:
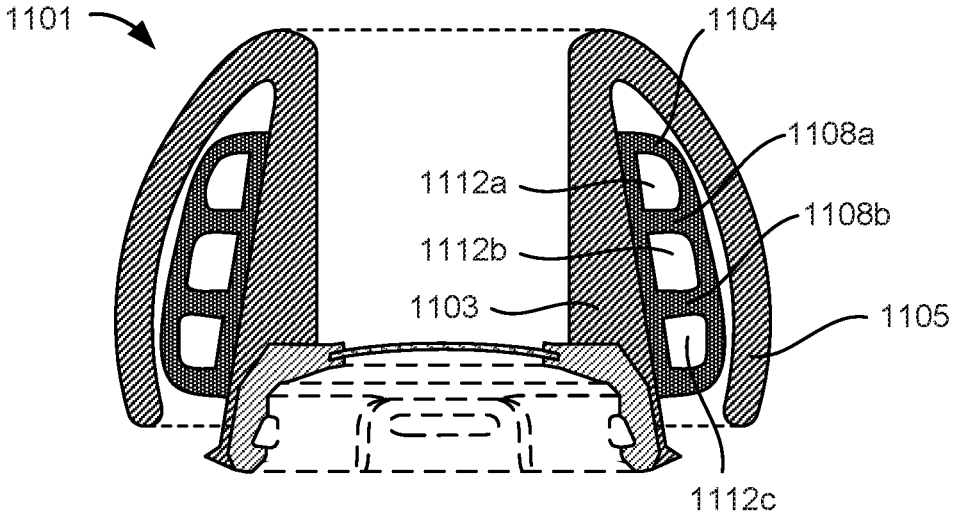

FIGS. 11A and 11B are cross-sectional views of exemplary eartips 1100 and 1101 including support structures 1102 and 1104 having reinforcement components 1106 and 1108*a-b*, respectively, according to some embodiments of the present disclosure. Reinforcement component 1106 of support structure 1102 can be a ring that extends around a circumference of inner eartip body 1103 and completely through the inner region to separate it into two inner regions 1110*a-b*. Similarly, reinforcement components 1108*a-b* of support structure 1104 can be rings that extend around a circumference of inner eartip body 1103 and completely through the inner region to separate it into three inner regions 1112*a-c*. Reinforcement components 1106 and 1108*a-b* can provide additional resistance against the total collapse of outer eartip body 1105. In some embodiments, reinforcement component 1106 is positioned at the center of support structure 1102, and reinforcement components 1108*a-b* are positioned to be equally spaced apart from each other and the opposing far ends (lengthwise) of support structure 1104, so that reinforcement components 1106 and 1108*a-b* can be positioned evenly along the length of respective support structures 1102 and 1104 to resist the deflection of outer eartip body 1105 evenly along the length of support structures 1102 and 1104 and improve the amount of surface area that contacts the inner surfaces of an ear canal. It is to be appreciated that additional reinforcement components can be added to provide additional assistance against the collapsing of outer eartip body 1105 and for providing a spreading of pressure against the surfaces of the ear canal.

While FIGS. 11A and 11B discuss reinforcement components 1106 and 1108*a-b* as rings, embodiments are not limited to such configurations. Other embodiments can have reinforcement components that are formed as posts that are evenly distributed around the inner region to spread the pressure against the surfaces of the ear canal. Any suitable configuration of reinforcement components in-line with the spirit and scope of the present disclosure to spread pressure and maximize the amount of surface area contacting the inner surfaces of an ear canal are envisioned herein.

Figure 12A:
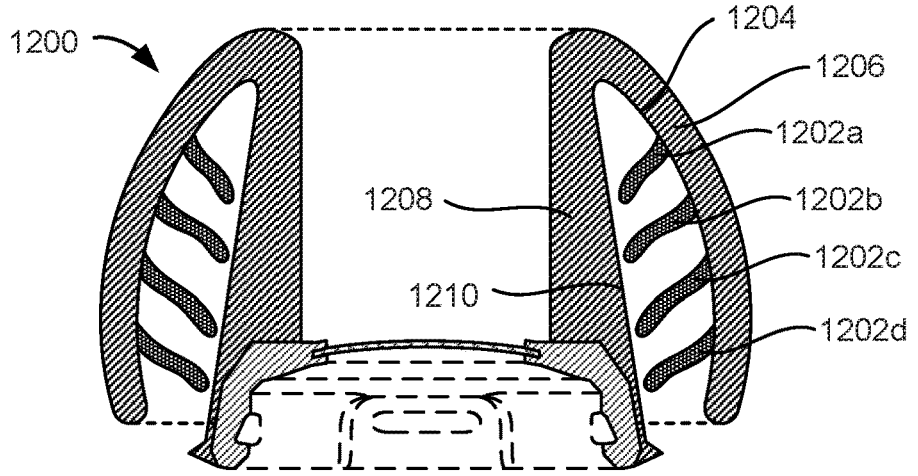
FIGS. 12A-12B are cross-sectional views of exemplary eartips having support structures configured as flanges, according to some embodiments of the present disclosure.
Figure 12B:
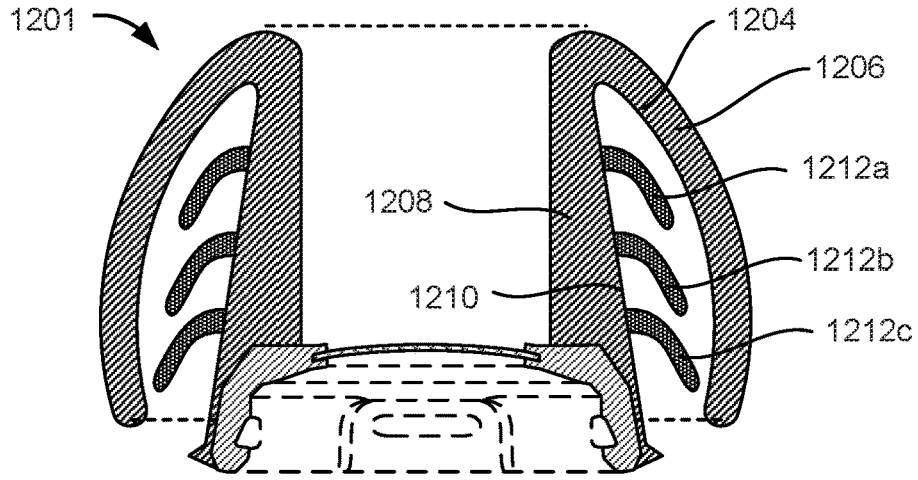
Figure 12C:
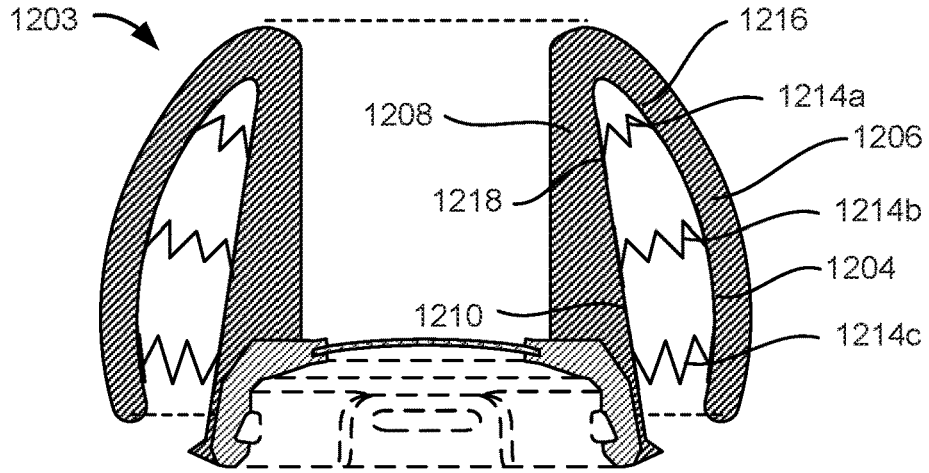
FIG. 12C is a cross-sectional view of an exemplary eartip 1203 having support structures configured as springs, according to some embodiments of the present disclosure.

Although FIGS. 10A-10B and 11A-11B illustrates support structures having an inner eartip body-like construction that includes a shell and an inner region, embodiments are not limited to such configurations. For instance, other embodiments can include support structures that may not be formed of a shell and an inner region, but are instead completely formed of a solid, compliant structure. For instance, support structure 1002 in FIG. 10A can be a solid structure formed of a foam or honeycomb material. In other instances, support structures can be constructed as flanges or springs, as discussed herein with respect to FIGS. 12A-12C. Specifically, FIGS. 12A and 12B are cross-sectional views of exemplary eartips 1200 and 1201 having support structures configured as flanges, and FIG. 12C is a cross-sectional view of an exemplary eartip 1203 having support structures configured as springs, according to some embodiments of the present disclosure. These support structures can be configured to resist uneven deformation of the outer eartip body so that pressure is spread evenly across the inner surface of the ear canal, thereby mitigating the creation of pressure points to improve comfort and acoustic seal.

As shown in FIG. 12A, eartip 1200 can include a plurality of support structures 1202*a-d* constructed as flanges that extend from an inner surface 1204 of outer eartip body 1206 toward inner eartip body 1208 without making contact with inner eartip body 1208 until eartip 1200 is inserted into an ear canal. Each support structure 1202*a-d* can be similar in construction and configuration to internal sound outer eartip body 824 except that support structures 1202*a-d* may be positioned evenly along a length of inner surface 1204 so that support structures 1202*a-d* can provide resistive force across a majority, if not the entire, length of inner surface 1204.

Alternatively, support structures can be configured as flanges that extend from the inner eartip body of an eartip, as shown in FIG. 12B. For example, eartip 1201 can include a plurality of support structures 1212*a-c* constructed as flanges that that extend from an outer surface 1210 of inner eartip body 1208 toward inner surface 1204 of outer eartip body 1206 without making contact with inner surface 1204 until eartip 1200 is inserted into an ear canal. Support structures 1212*a-c* can be positioned evenly along a length of outer surface 1210 of inner eartip body 1208 so that support structures 1212*a-c* can provide resistive force across a majority, if not the entire, length of inner surface 1204.

As briefly mentioned herein, eartip 1203 can include a plurality of support structures 1214*a-c* constructed as springs that bridge between an inner surface 1204 of outer eartip body 1206 and inner eartip body 1208, as shown in FIG. 12C. Each support structure 1214*a-c* can include a linear spring that can apply a resistive force against compression to evenly spread pressure across a wide area. When configured as a linear spring, each opposing end of the spring can be attached to a respective base plate 1216 and 1218 that can provide a rigid platform to which the spring can attach to and also provide a surface for the support structure to attach to surfaces 1210 and 1204 of inner eartip body 1208 and outer eartip body 1206, respectively. Although FIG. 12C illustrates coil springs, embodiments are not limited to such configurations and that any suitable mechanical feature capable of applying linear force in the same manner are envisioned herein, such as elastic posts.

Support structures discussed herein can be formed of any material suitable for resisting the total collapse of the outer eartip body. For instance, support structures can be formed of a nylon material that is rigid but has enough elasticity to compress a certain degree while resisting compressive force. Support structures can also be formed of silicone, which can be the same silicone material used to form the inner eartip body and outer eartip body. In some embodiments, support structures can be formed of the above-mentioned materials reinforced with filaments, such as fabric filaments and/or nylon filaments to achieve a targeted compression rate.

E. Dynamic Outer Eartip Bodies

As can be appreciated herein, the outer eartip body of an eartip according to some embodiments of the present disclosure can press against an inner surface of an ear canal to form an acoustic seal, according to some embodiments of the present disclosure. This acoustic seal can enhance the quality of sound experience by the user, but it can also sometimes be improperly fitted to the ear canal. Thus, in some embodiments, the eartip can include a dynamic outer eartip body that can alter its diameter/cross-sectional size to complement the diameter of the ear canal in which it is inserted.

Figure 13A:
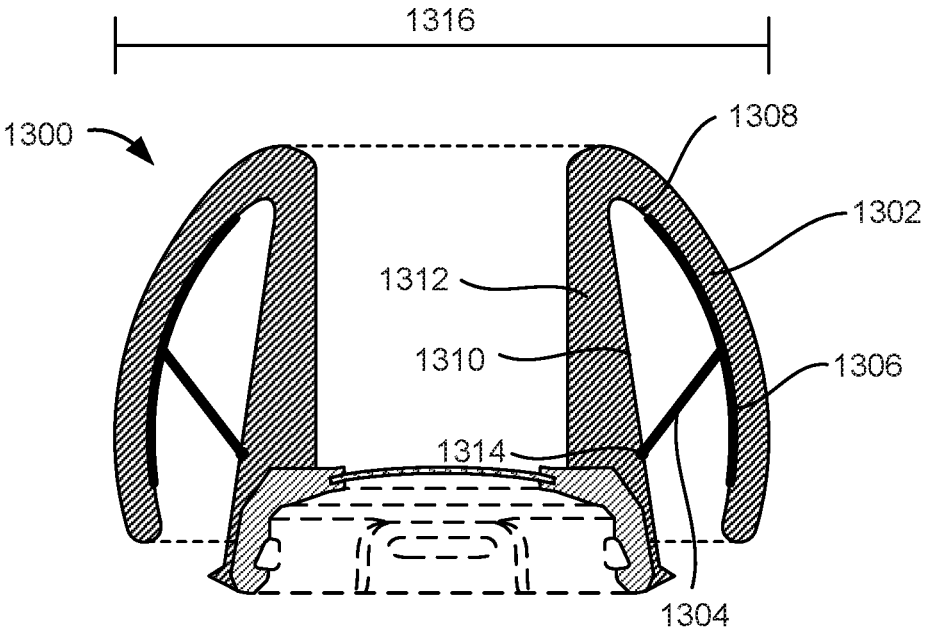
FIGS. 13A-13B are cross-sectional views of an exemplary eartip including a dynamic outer eartip body in a sliding rod configuration, according to some embodiments of the present disclosure.
Figure 13B:
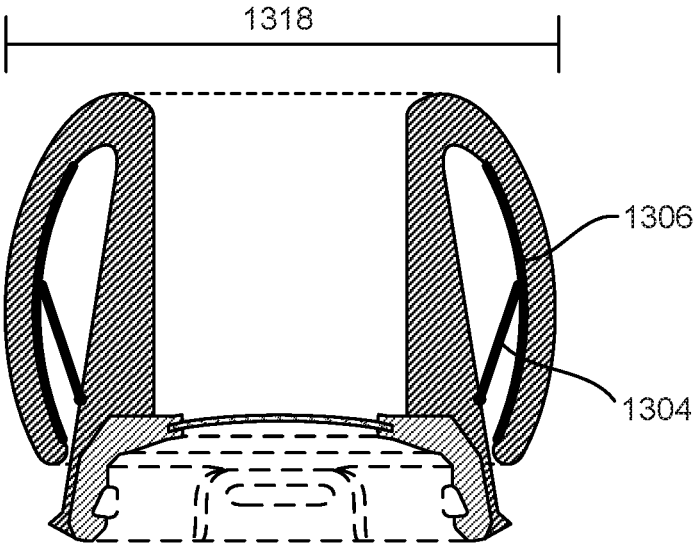

FIGS. 13A-13B are cross-sectional views of an exemplary eartip 1300 including a dynamic outer eartip body 1302 in a sliding rod configuration, according to some embodiments of the present disclosure. Dynamic outer eartip body 1302 can include a rod 1304 and a track 1306 along which rod 1304 can slide along the length of outer eartip body 1302 to alter its diameter. Track 1306 can be attached to inner diameter 1308 of outer eartip body 1302, and rod 1304 can be attached to outer surface 1310 of inner eartip body 1312. In some embodiments, rod 1304 can be attached to a hinge 1314 disposed on outer surface 1310 so that rod 1304 can slide along track 1306 while being in a fixed position on outer surface 1310. When eartip 1300 is not inserted into an ear canal, dynamic outer eartip body 1302 can have a first diameter 1316. However, when eartip 1300 is inserted into an ear canal, dynamic outer eartip body 1302 can alter its diameter to second diameter 1318 that is smaller than first diameter 1316 to fit and conform to the size of the ear canal. In some embodiments, rod 1304 can slide upward along track 1306 to allow dynamic outer eartip body 1302 to alter its diameter like an umbrella, as shown in FIG. 13B. By being able to dynamically alter its diameter/cross-sectional size, dynamic outer eartip body 1302 can better fit into a variety of ear canals, thereby improving its comfort and acoustic seal across a wide range of ear canal sizes. In certain embodiments, several rods and tracks are implemented around a circumference of inner eartip body 1312 and positioned equally spaced apart from one another in a symmetrical arrangement when viewed top-down.

Although FIGS. 13A and 13B illustrate track 1306 being formed on outer eartip body 1302 and rod 1304 being attached to outer surface 1310, embodiments are not limited to such a configuration. In some instances, track 1306 can be formed on outer surface 1310, and rod 1304 can be attached to outer eartip body 1302 and configured to slide along track 1306, e.g., slide along outer surface 1310, to change the diameter of outer eartip body 1302. As an example, a spiral track can be formed around outer surface 1310 of inner eartip body 1312, and a single, circular track can be formed around inner surface 1308 of outer eartip body 1302. One end of rod 1304 can be set in the spiral track while the other opposite end can be set in the circular track. In such instances, as rod 1304 rotates with respect to inner eartip body 1312 and outer eartip body 1302, the angle of rod 1304 with respect to inner eartip body 1312 can change, thereby altering the diameter of eartip 1300. This rotational movement can be effectuated by the user making a twisting/screwing motion on eartip 1300. It is to be appreciated that any other suitable implementation is envisioned herein without departing from the spirit and scope of the present disclosure.

Figure 14A:
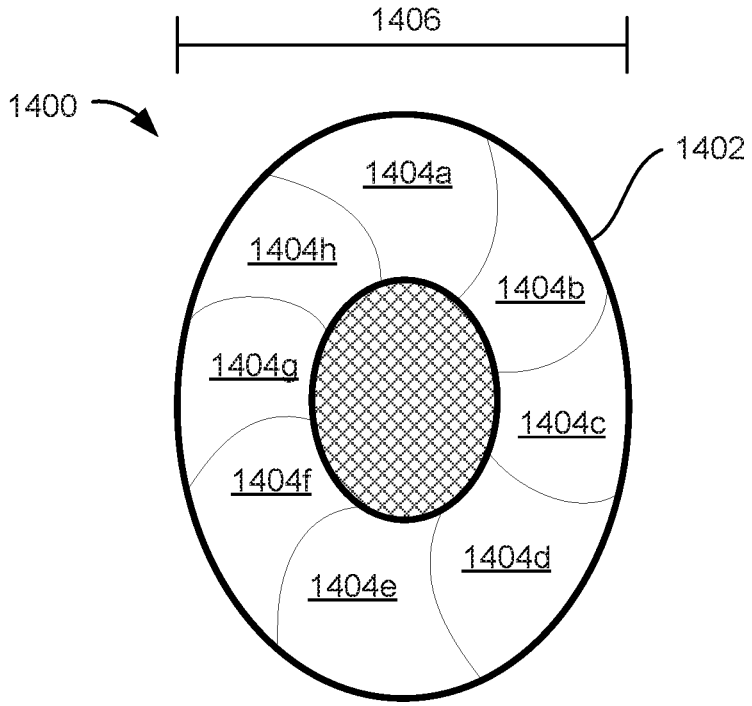
FIGS. 14A-14B are top-down views of an exemplary eartip including a dynamic outer eartip body in a sliding plate configuration, according to some embodiments of the present disclosure.
Figure 14B:
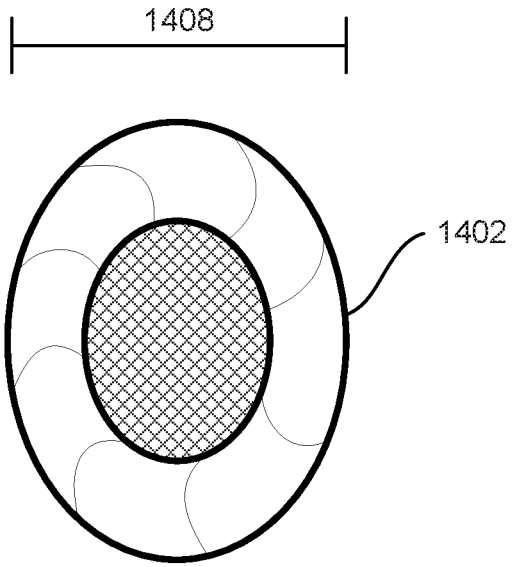

In some embodiments, the dynamic outer eartip body can be configured in a sliding plate configuration. FIGS. 14A-14B are top-down views of an exemplary eartip 1400 including a dynamic outer eartip body 1402 in a sliding plate configuration, according to some embodiments of the present disclosure. Dynamic outer eartip body 1402 can include a plurality of segments 1404*a-h* that can slide against and overlap portions of one another to alter its diameter/size. As more overlap between segments 1404*a-h* is achieved, the diameter of dynamic outer eartip body 1402 decreases. For instance, when eartip 1400 is not inserted into an ear canal, dynamic outer eartip body 1402 can have a first diameter 1406. However, when eartip 1400 is inserted into an ear canal, as shown in FIG. 14B, dynamic outer eartip body 1402 can alter its diameter to second diameter 1408 that is smaller than first diameter 1406 to fit and conform to the size of the ear canal. By being able to dynamically alter its diameter/cross-sectional size, dynamic outer eartip body 1402 can better fit into a variety of ear canals, thereby improving its comfort and acoustic seal across a wide range of ear canal sizes.

Although embodiments herein discuss eartips with an outer eartip body formed as a cantilevered structure that has one end freely suspended a distance away from the inner eartip body and defines a deflection zone, embodiments are not limited to such embodiments. Rather, some embodiments can have both ends of the outer eartip body extend from the inner eartip body to define a cavity within which materials can fill to form a pliable structure.

Figure 15A:
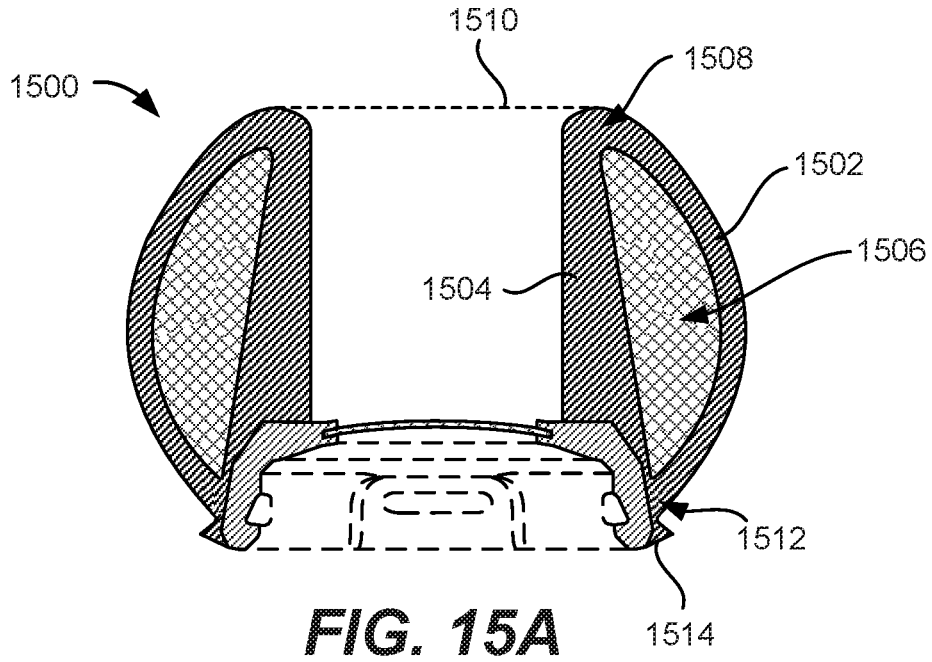
FIGS. 15A-15B are cross-sectional views of an exemplary eartip having an outer eartip body that extends from two regions of an inner eartip body to define an enclosed pocket, according to some embodiments of the present disclosure.
Figure 15B:
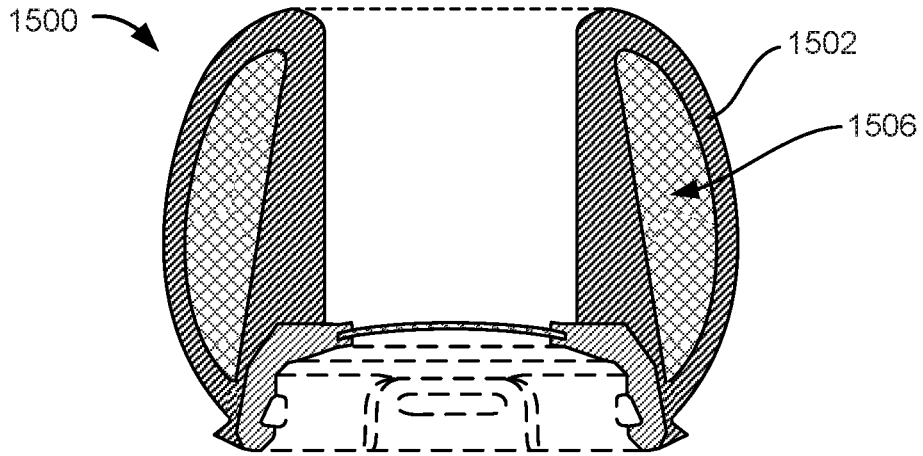

FIGS. 15A-15B are cross-sectional views of an exemplary eartip 1500 having an outer eartip body 1502 that extends from two regions of an inner eartip body 1504 to define an enclosed pocket 1506, according to some embodiments of the present disclosure. Outer eartip body 1502 can extend from a first region 1508 of inner eartip body 1504 at an interfacing end 1510 of the eartip body and from a second region 1512 of inner eartip body 1504 near an attachment end 1514 of the eartip body. Outer eartip body 1502 can extend between first region 1508 and second region 1512 and curve away from inner eartip body 1504 in a concave profile. The curvature of outer eartip body 1502 can define pocket 1506 within which vacant space can reside. The vacant space can provide a region within which one or more fillers can be contained. Any suitable filler that provides a soft, compliant structure for allowing outer eartip body 1502 to conform and contour to the inner surfaces of an ear canal can be used, such as a foam material that can change its volume without changing its mass, or any other material having a viscoelastic property that compresses quickly yet rebounds slowly. One of such materials can be an undercured fluorosilicone material. That way, when eartip 1500 is inserted into an ear canal, outer eartip body 1502 can compress into pocket 1506 and the filler material can resist deformation of outer eartip body 1502 to provide a soft, comfortable feel as shown in FIG. 15B.

Because outer eartip body 1502 extends from two regions of inner eartip body 1504 and does not have a cantilevered structure, outer eartip body 1502 may not need high structural rigidity. Instead, outer eartip body 1504 can be formed of a soft, highly compliant material, such as a thin silicone layer or a fabric. Outer eartip body 1504 may only need to operate as a membrane that holds the filler material in pocket 1506. Although FIGS. 15A-15B illustrate eartip 1500 as having a pocket 1506 that can be vacant space or occupied with a filler material, embodiments are not so limited. In some additional embodiments, no pocket may exist. Instead, the outer eartip body can be molded with the inner eartip body and thus form a solid structure.

It is to be appreciated that while embodiments herein discuss eartips having eartip bodies molded onto attachment structures for coupling with a housing, embodiments herein do not require eartips to be formed with attachment structures. Instead, eartips having features discussed herein can be directly fused onto the housing without the use of an attachment structure. Thus, eartips can be formed of a soft, monolithic structure that is directly attached to the housing and not separable from the housing. The entire eartip can be formed of only one material that is soft and compliant, like silicone, or it can include a filler material as discussed herein.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

Although the invention has been described with respect to specific embodiments, it will be appreciated that the invention is intended to cover all modifications and equivalents within the scope of the following claims.

What is claimed is:

1. An eartip, comprising:

an eartip body having an attachment end and an ear interfacing end opposite from the attachment end, the eartip body formed from a compliant material and comprising:

an inner eartip body having a sidewall that defines a sound channel extending through the eartip body between the ear interfacing end and the attachment end; and an outer eartip body integrally formed with the inner eartip body at the ear interfacing end and extending towards the attachment end around at least a portion of and in a spaced apart relationship with the inner eartip body, wherein the outer eartip body is sized and shaped to be inserted into an ear canal; and wherein the inner eartip body includes a plurality of grooves formed in an outer surface of the sidewall with each groove in the plurality of grooves facing an inner surface of the outer eartip body.

2. The eartip of claim 1, wherein at least one groove in the plurality of grooves is defined by a base wall extending between two sidewalls.

3. The eartip of claim 2, wherein the base wall and at least one sidewall of the two sidewalls are arranged perpendicular to one another.

4. The eartip of claim 1, wherein the plurality of grooves includes a first groove and the inner eartip body includes a second groove spaced apart from the first groove along a length of the inner eartip body.

5. The eartip of claim 1, wherein the inner eartip body further comprises a boundary positioned between the interfacing end and the attachment end, and wherein the sidewall gradually changes in thickness from the first thickness to the second thickness from the boundary to the interfacing end.

6. The eartip of claim 5, wherein at least one groove in the plurality of grooves is defined by a base wall extending between two sidewalls having different lengths.

7. The eartip of claim 1, wherein at least one groove in the plurality of grooves extends around a circumference of the inner eartip body.

8. The eartip of claim 1, further comprising an internal sound sealing structure extending from the inner eartip body and positioned between the plurality of grooves and the attachment end.

9. The eartip of claim 8, wherein the internal sound sealing structure is a flange that extends toward the outer eartip body.

10. The eartip of claim 1, further comprising a support structure extending from the inner eartip body toward the outer eartip body.

11. The eartip of claim 10, wherein the support structure comprises a shell and an inner region filled with air.

12. The eartip of claim 1, further comprising an attachment structure coupled to the inner eartip body at the attachment end of the eartip body.

13. The eartip of claim 1, further comprising:

a rigid attachment structure coupled to the inner eartip body at the attachment end, the rigid attachment structure defining a plurality of recesses and including a mesh extending across the sound channel.

14. The eartip of claim 13, wherein the plurality of grooves are positioned closer to the attachment end than the interfacing end.

15. The eartip of claim 1 wherein the plurality of grooves form a bend region that mitigates potential kinking or buckling when the eartip is inserted into an ear canal.

16. The eartip of claim 1 wherein a deflection zone is formed between the inner eartip body and the outer eartip body and wherein each groove in the plurality of grooves is open to the deflection zone.

17. The eartip of claim 1 wherein at least one groove in the plurality of grooves formed in the outer surface of the sidewall extends around an entire perimeter of the inner eartip body.

18. An eartip, comprising:

an eartip body having an attachment end and an interfacing end opposite from the attachment end, the eartip body comprising:

an inner eartip body having a sidewall extending between the interfacing end and the attachment end, the inner eartip body including a groove formed in an outer surface of the sidewall; and an outer eartip body sized and shaped to be inserted into an ear canal and extending from the interfacing end toward the attachment end of the eartip;

wherein the groove is a first groove and the inner eartip body includes a second groove spaced apart from the first groove along a length of the inner eartip body and wherein the first groove and the second groove are positioned closer to the attachment end than the interfacing end.

19. An eartip, comprising:

an eartip body having an attachment end and an ear interfacing end opposite from the attachment end, the eartip body formed from a compliant material and comprising:

an inner eartip body having a sidewall that defines a sound channel extending through the eartip body between the ear interfacing end and the attachment end; and an outer eartip body integrally formed with the inner eartip body at the ear interfacing end and extending towards the attachment end around at least a portion of and in a spaced apart relationship with the inner eartip body, wherein the outer eartip body is sized and shaped to be inserted into an ear canal;

a support structure extending from the inner eartip body toward the outer eartip body; and wherein the inner eartip body includes a groove formed in an outer surface of the sidewall facing an inner surface of the outer eartip body; and wherein the support structure comprises a plurality of flanges, each extending around the circumference of the inner eartip body and positioned across a majority of the length of the inner eartip body.

20. An in-ear listening device, comprising:

a housing defining a cavity and an acoustic opening;

a driver positioned within the housing and operatively coupled to emit sound through the acoustic opening; and an eartip removably attached to the housing and aligned with the acoustic opening, the eartip comprising:

an eartip body having an attachment end and an ear interfacing end opposite from the attachment end, the eartip body formed from a compliant material and comprising:

an inner eartip body having a sidewall that defines a sound channel extending through the eartip body between the ear interfacing end and the attachment end; and an outer eartip body integrally formed with the inner eartip body at the ear interfacing end and extending towards the attachment end surrounding at least a portion of and in a spaced apart relationship with the inner eartip body, wherein the outer eartip body is sized and shaped to be inserted into an ear canal; and wherein the inner eartip body includes a plurality of grooves formed in an outer surface of the sidewall with each groove in the plurality of grooves facing an inner surface of the outer eartip body.

21. The in-ear listening device of claim 20, wherein the eartip further comprises a rigid attachment structure coupled to the inner eartip body at the attachment end, the rigid attachment structure defining a plurality of recesses and including a mesh extending across the channel.

22. The in-ear listening device of claim 20, wherein at least one groove in the plurality of grooves is defined by a base wall extending between two sidewalls.

23. An eartip, comprising:

an eartip body having an attachment end and an ear interfacing end opposite from the attachment end, the eartip body formed from a compliant material and comprising:

an inner eartip body having a sidewall that defines a sound channel extending through the eartip body between the ear interfacing end and the attachment end; and an outer eartip body integrally formed with the inner eartip body at the ear interfacing end and extending towards the attachment end around at least a portion of and in a spaced apart relationship with the inner eartip body, wherein the outer eartip body is sized and shaped to be inserted into an ear canal; and wherein the inner eartip body includes a plurality of grooves formed in an outer surface of the sidewall with each groove in the plurality of grooves extending around an entire perimeter of the inner eartip body and facing the inner surface of the outer eartip body.

* * * * *